US006317961B1

(12) United States Patent
Yamada

(10) Patent No.: US 6,317,961 B1
(45) Date of Patent: Nov. 20, 2001

(54) WIRE LAYING APPARATUS, A WIRE LAYING METHOD, A WIRE LAYING MOLD, A WIRE STRAIGHTENING MECHANISM AND A BACKUP ASSEMBLY OF A PRESS INSULATION-DISPLACING MECHANISM

(75) Inventor: Takayuki Yamada, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/452,495

(22) Filed: Dec. 1, 1999

(30) Foreign Application Priority Data

Dec. 4, 1998 (JP) ..... 10-346119
Dec. 4, 1998 (JP) ..... 10-346120
Dec. 4, 1998 (JP) ..... 10-346121
Dec. 4, 1998 (JP) ..... 10-346122

(51) Int. Cl.[7] ..... H01R 43/00
(52) U.S. Cl. ..... 29/564.2; 29/33 M; 29/755
(58) Field of Search ..... 29/33 M, 33 K, 29/755, 564.2, 850, 748, 739, 745, 564.7, 564.8; 140/92.1, 93 R

(56) References Cited

U.S. PATENT DOCUMENTS 4,648,180 * 3/1987 Holt ..... 29/33 M X
5,289,633 3/1994 Okafuji et al. ..... 29/566.2 X
5,345,978 * 9/1994 Okafuji et al. ..... 29/755 X
5,390,710 2/1995 Kato et al. ..... 29/755 X
5,412,861 5/1995 Fuddo et al. ..... 29/564.2
5,694,680 12/1997 Yamada et al. ..... 29/745 X
5,778,578 * 7/1998 Saka et al. ..... 29/850
5,832,602 * 11/1998 Uezono et al. ..... 29/755 X

FOREIGN PATENT DOCUMENTS 0 044 636 1/1982 (EP) .
08079943 3/1996 (JP) .
8-79943 3/1996 (JP) .
09148036 6/1997 (JP) .
9-148036 6/1997 (JP) .
4-71178 * 3/1992 (JP) ..... 29/33 M

* cited by examiner

*Primary Examiner*—William Briggs
(74) *Attorney, Agent, or Firm*—Anthony J. Casella; Gerald E. Hespos

(57) ABSTRACT

A wire laying apparatus is provided which can easily position a wire with respect to a work and improve an operability when the wire is laid on the work. The wire laying apparatus is provided with a base 12, a turntable 13, a support frame 14, a wire laying mechanism 50, a press cutting mechanism 100 and a press insulation-displacing mechanism 150. Pieces of an insulated wire 62 to which a wire laying process and a press cutting process have been applied are pushed by pushing portions 157 from above a wire laying mold 16 during a press insulation-displacing process, thereby being transferred from the wire laying mold 16 to a work piece 181 located below. In this case, the pieces of the insulated wire 62 tightly held by the wire laying mold 16 are transferred to specified positions on the work piece 181 while a layout pattern thereof is maintained, and laid on the work 181 while being fastened to wire mounts and insulating-displacing pieces.

19 Claims, 18 Drawing Sheets

WIRE LAYING APPARATUS, A WIRE LAYING METHOD, A WIRE LAYING MOLD, A WIRE STRAIGHTENING MECHANISM AND A BACKUP ASSEMBLY OF A PRESS INSULATION-DISPLACING MECHANISM

BACKGROUND OF THE INVENTION

1. Field of the Invention

The present invention relates to a wire laying apparatus and to a wire laying method. Furthermore, the present invention relates to a wire laying mold used to lay a wire, and to a wire straightening mechanism used to straighten a wire laid on a wire laying mold. Finally, the present invention relates to a backup assembly of a press insulation-displacing mechanism to position a work piece with respect to a wire laying mold.

2. Description of the Related Art

A wire laying apparatus has been proposed for laying a wire in a wire laying mold. The wire laid by this previously proposed apparatus is transferred to a work piece while keeping a layout pattern of the wire. A wire laying surface of this mold is formed with a wire laying groove that forms the layout pattern. The layout pattern in the wire laying mold is an inverse of a desired layout pattern in the work piece.

The above-described wire laying apparatus is used by first laying the wire in the wire laying groove of the wire laying mold. The layout pattern of the wire then is finalized by cutting and removing any unnecessary portions of the wire. Subsequently, the work piece is placed above the wire laying mold with the wire laying surfaces of the work piece and the wire laying mold being opposed to each other. The wire then is transferred to the work piece by being pushed up toward the work piece by push-up pins that penetrate through the wire laying mold.

Such a work piece is provided with a holding member for holding the transferred wire in its layout pattern. Accordingly, the wire is laid in the work piece while being supported by the holding member and then is transferred from the wire laying mold to the work piece located thereabove.

As noted above, the aforementioned known wire laying apparatus is used by placing the work piece above the wire laying mold with the wire laying surface of the work piece opposed to that of the wire laying mold while laying the wire in the work piece. Thus, it is difficult to position the holding member of the work piece with respect to the layout pattern formed on the wire laying mold. This difficulty may lead to a reduction in operability and a higher defect rate of products.

A wire laying mold of the above mentioned type conventionally has been made of a metal, and has been formed with a wire laying groove that conforms with a specified position and a specified layout pattern of an insulated wire. In other words, the wire laying groove is formed by cutting the wire laying mold to produce a wire laying mold of a specified shape. The insulated wire then is laid along the wire laying groove of the wire laying mold. However, with the before mentioned conventional wire laying mold, a plurality of wire laying molds having wire laying grooves corresponding to the positions and layout patterns of the insulated wire have to be prepared. Thus, a single wire laying mold cannot accommodate different positions and layout patterns of the insulated wire, and therefore cannot provide a wide range of applications.

Generally, the wire is laid along a wire laying groove in the wire laying mold before being urged into the groove. In this case, the wire laid in the wire laying groove may be buckled or twisted. Such buckling and twisting of the wire may cause a reduction in the operability of processes performed after the wire is laid. To solve this problem, there has been a demand for the removal of buckles and twists of the wire laid in the wire laying mold.

Unnecessary portions of the wire are removed while laying the wire along the wire laying groove formed in the wire laying mold. Thereafter, the wire laying mold that carries the wire laid in the specified pattern is positioned with respect to the work piece, such as an insulating substrate, to transfer the wire on the wire laying mold to the work piece. In other words, the work piece is fixed in a specified position above the wire laying mold, and the wire laying mold is movably provided to be positioned in conformity with the work piece.

However, in the aforementioned positioning mechanism, the wire in the specified pattern on the wire laying mold is a mirror image to a layout pattern of the wire to be laid on the work, i.e. oriented in an opposite direction. Accordingly, the work and the wire laying mold may not be positioned properly when the wire on the wire laying mold is transferred to the work.

The present invention was developed in view of the above problems and an object thereof is to provide a wire laying apparatus and a wire laying method which can position a wire easily and securely with respect to a work or work piece when laying the wire in the work or work piece, thereby improving an operability and reducing a defect rate.

It is a further object of the invention to provide a wire laying mold which can accommodate different positions and layout patterns of a wire and which can provide a wider range of application.

It is a another object of the invention to provide a wire straightening mechanism which can straighten a wire laid in a wire laying mold by removing buckles and twists of the wire.

Furthermore, it is a further object of the invention to provide a backup assembly of a press insulation-displacing mechanism which can properly position a work piece and a wire laying mold with respect to each other when a wire laid on the wire laying mold is transferred to the work.

SUMMARY OF THE INVENTION

According to the invention, there is provided a wire laying apparatus for laying a wire on a work piece. The apparatus comprises a wire laying mechanism for laying the wire on a wire laying mold substantially from above the wire laying mold. A press cutting mechanism is provided for pressing the wire after being laid and cutting unnecessary portions of the wire, and a press insulation-displacing or transferring mechanism is provided for transferring the wire after the press cutting from the wire laying mold to the work piece that is located below the wire laying mold. Accordingly, the wire can be positioned easily with respect to the work piece when the wire is laid on the work piece, thereby improving an operability.

According to a preferred embodiment of the invention, the press insulation-displacing mechanism comprises a press insulation-displacing assembly, and the wire is brought or bringable substantially into contact with wire mounts and insulation-displacing pieces of the work piece by an insulation-displacing portion of the press insulation-displacing assembly. Accordingly, the wire can be laid on the work piece while being pushed into contact with the wire mounts and the insulation-displacing pieces by the pushing portion of the press insulation-displacing assembly.

Preferably, a pair of recesses are formed at the leading end of each insulation-displacing portion which is formed to have a substantially T-shaped cross-section. Accordingly, the pushing portions can have their pushing degree controlled by the T-shaped cross section of the leading ends of the pushing portions, and can be brought stably into contact with the wire to be transferred from the wire laying mold to the work piece.

Further preferably, the press cutting mechanism and the insulation-displacing mechanism are provided on a base, and a turntable is provided on the base for conveying the work piece to positions corresponding to the wire laying mechanism, the press cutting mechanism and the insulation-displacing mechanism while holding the work piece.

Still further preferably, the wire laying mechanism comprises a wire feeder provided on or at a side of the base, and a wire laying robot is provided on the base. A backup assembly also is provided on the base so that the turntable is arranged substantially between the wire laying robot and the backup assembly.

Most preferably, the press cutting mechanism comprises a press cutting assembly provided on the base, and a backup assembly provided on the base so that the turntable is arranged substantially between the press cutting assembly and the backup assembly.

According to the invention there is further provided a wire laying method comprising a step of feeding a wire onto wire laying mold by means of a wire laying mechanism. The method subsequently proceeds by press cutting the wire arranged on the wire laying mold by means of a press cutting mechanism thereby forming cut portions of the wire arranged in the wire laying mold. The method then includes transferring the cut portions of the wire to a work piece by means of a press insulation-displacing or transferring mechanism.

According to a preferred embodiment of the invention, the wire laying mold is transferred by means of a turntable that is activated after each step.

According to the invention, there is further provided a wire laying mold comprising a frame and guide blocks. Guide holes are used to lay a wire, and are formed inside the frame by fixing the guide blocks in specified positions with respect to the frame. The wire laying mold can provide a wide range of application by accommodating different positions and layout patterns of the wire to be laid along the guide holes thereof. Further, since the wire laying mold is constructed by separate members, namely the frame and the guide blocks, it is sufficient to exchange at least one of the frame and the guide blocks when the wire laying mold needs to be exchanged. This leads to a reduced exchange cost for the wire laying mold and, therefore, a reduction in production costs.

According to a preferred embodiment of the invention, the frame is formed with one or more internally threaded portions and the guide blocks are formed with oblong holes. The frame and the guide blocks are fixed adjustably to each other by bolts. Accordingly, the fixed positions of the guide blocks with respect to the frame can be adjusted finely by the oblong holes of the guide blocks.

Preferably, bottom portions of the guide blocks are formed with projections that have pointed ends so as to tightly hold the wire when a press cutting process is applied to the wire. Accordingly, the insulating coating of the insulated wire can be torn or made easy to tear since the insulated wire is pushed to the bottom of the guide blocks while being held in contact with the projection when the press cutting process is applied. Further, the insulated wire can be prevented from dropping out of the guide holes of the wire laying mold by being tightly held by the projections.

The guide blocks preferably are formed with support portions projecting at their bottom portions so as to tightly hold the insulated wire when the press cutting process is applied to the insulated wire. Accordingly, the insulated wire can be prevented from dropping out of the guide holes of the wire laying mold since it is tightly held by the support portions when the press cutting process is applied thereto. Further, the insulated wire can be prevented from moving up or displacing during the press cutting process by being tightly held by the support portions.

Still further preferably, the pointed projections are in the form of a triangular prism. With such projections, the insulating coating of the insulated wire can be torn or made easy to tear, and the insulated wire can be prevented from dropping out of the guide holes of the wire laying mold.

Furthermore, according to the invention, a wire straightening mechanism is provided for pressing a wire laid on a wire laying mold, so as to substantially straighten the wire. Accordingly, the wire laid on the wire laying mold can be straightened by being pressed by the wire straightening mechanism.

According to a preferred embodiment, the wire is pressed by at least one pressing block. Accordingly, the straightening can be made more secure by pressing the wire by the pressing blocks.

Preferably, the wire is pressed to be straightened after the bottom surface of the wire laying mold is supported by a backup assembly. Accordingly, the processes after the wire laying process can be performed stably since the wire is straightened after the bottom surface of the wire laying mold is supported by the backup assembly.

Still further the backup portion is movably provided substantially upwardly and downwardly and is brought or bringable into contact with the wire laid on the wire laying mold in its upper position. The press cutting assembly includes the pressing blocks which are movable upwardly and downwardly and to press the wire laid on the wire laying mold together with the backup assembly in its lower position.

Most preferably, the press cutting assembly comprises dampers for elastically pressing the pressing blocks against the wire.

According to the invention, there is further provided a backup assembly of a press insulation-displacing mechanism for positioning a work piece with respect to a wire laying mold and for carrying a wire laid in a specified pattern from below the wire laying mold. Thus the wire laying mold and the work piece are held in predetermined or predeterminable positions when the wire on the wire laying mold is transferred to the work piece. Accordingly, the work piece and the wire laying mold can be positioned in the predetermined positions when the wire on the wire laying mold is transferred to the work piece.

According to a preferred embodiment, the work piece is moved to the predetermined position with respect to the wire laying mold by a conveying section and an elevating section. Accordingly, the positioning can be made more secure since the work piece is conveyed to the predetermined position by the conveying section and the elevating section.

Preferably, the work piece is accommodated on an accommodating table of the conveying section while being partly positioned, and is fixedly supported in the predetermined position while being positioned by one or more support rollers. Accordingly, the displacement of the work piece from the accommodating table can be prevented since it is fixed supported on the accommodating table of the conveying section while being positioned by the support rollers when it is in the predetermined position.

The backup assembly preferably comprises a positioning means for pressing the support rollers against the work piece as the work piece is conveyed to the elevating section by the conveying section, and cancelling the positioning of the work piece by the support rollers as the work piece is conveyed to its set position by the conveying section.

Most preferably, the positioning means comprises a cam in the vicinity of the set position of the work piece, and a cam follower that is engageable with the cam and including the support rollers which are rotatably biased to position the work piece.

These and other objects, features and advantages of the present invention will become more apparent upon a reading of the following detailed description and accompanying drawings.

DETAILED DESCRIPTION OF THE PREFERRED EMBODIMENT

Figure 1:
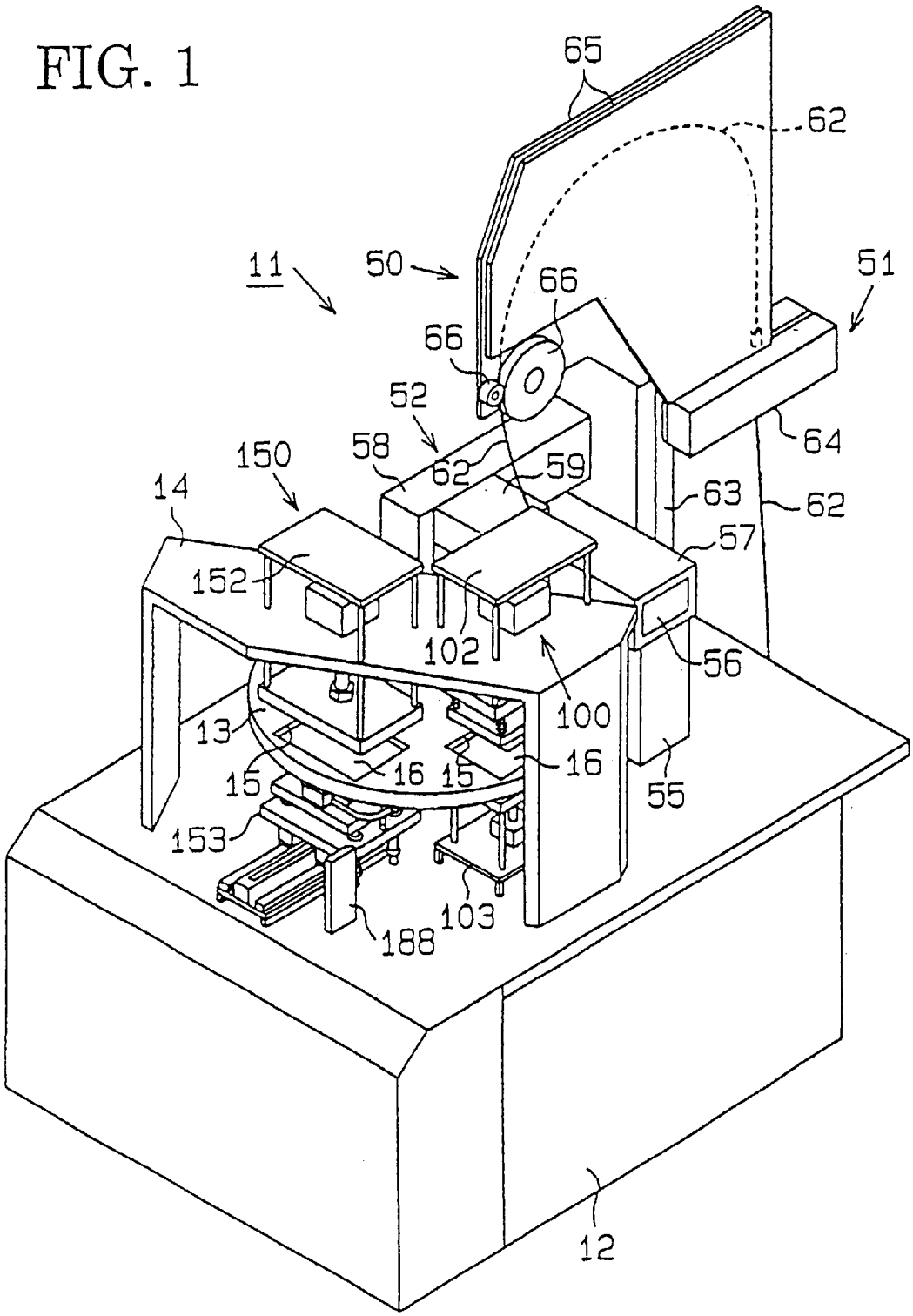
FIG. 1 is a perspective view showing a wire laying apparatus according to one embodiment of the invention.
Figure 2:
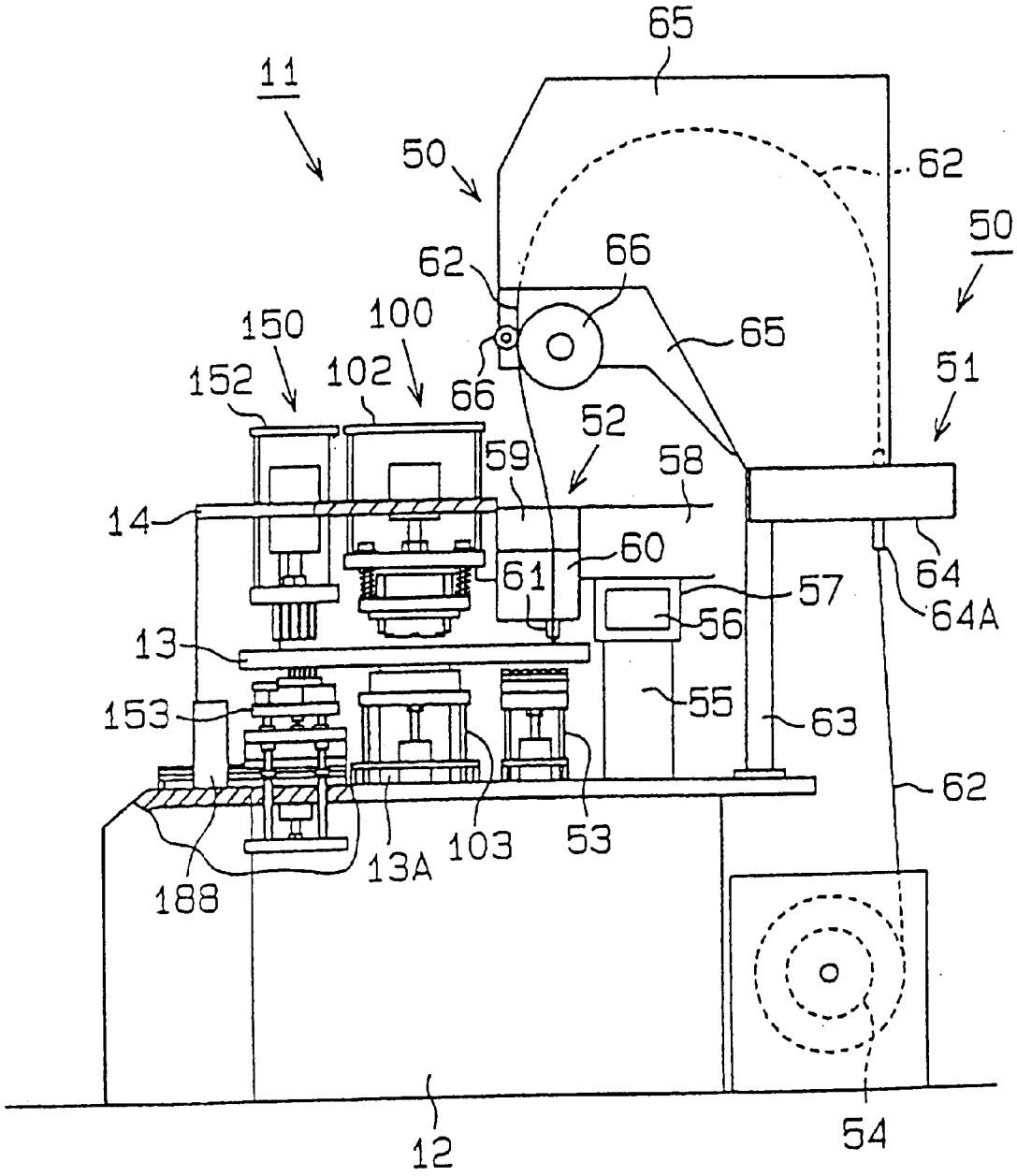
FIG. 2 is a side view partly in section of the wire laying apparatus of the embodiment.

As shown in FIGS. 1 and 2, a wire laying apparatus 11 in accordance with the invention is provided with a base 12, a substantially disk-shaped turntable 13 arranged on or at the base 12, a support frame 14 which is placed on the base to substantially surround the turntable 13, a wire laying mechanism 50, a press cutting mechanism 100 and a press insulation-displacing mechanism 150. The turntable 13 has its center rotatably supported by a support shaft 13A extending substantially upwardly from the base 12. The turntable 13 is formed with a plurality of mold mounting holes 15 which preferably are arranged substantially circumferentially at intervals of a specified (predetermined or predeterminable) angle. These mounting holes 15 substantially vertically penetrate through the turntable 13. In this embodiment, e.g. four mounting holes 15 are arranged at intervals of 90° in a circumferential direction of the turntable 13. Wire laying molds 16 are mounted in or on the respective mounting holes 15 such that upper surfaces thereof are substantially flush with the upper surface of the turntable 13. In this embodiment, the turntable 13 is intermittently rotated every 90° in a clockwise direction in FIG. 1.

The wire laying mechanism 50, the press cutting mechanism 100 and the press insulation-displacing mechanism 150 are provided in positions substantially corresponding to the respective mounting holes 15 when the turntable 13 is stationary. Specifically, the mechanisms 50, 100, 150 are provided at intervals of a specified angle which preferably corresponds substantially to the interval angle of the mounting holes 15 (90° in this embodiment) about the support shaft 13A. A position between the mechanisms 50 and 150 and opposite from the mechanism 100 over the support shaft 13A is a mount position for the wire laying molds as described later.

Figure 3:
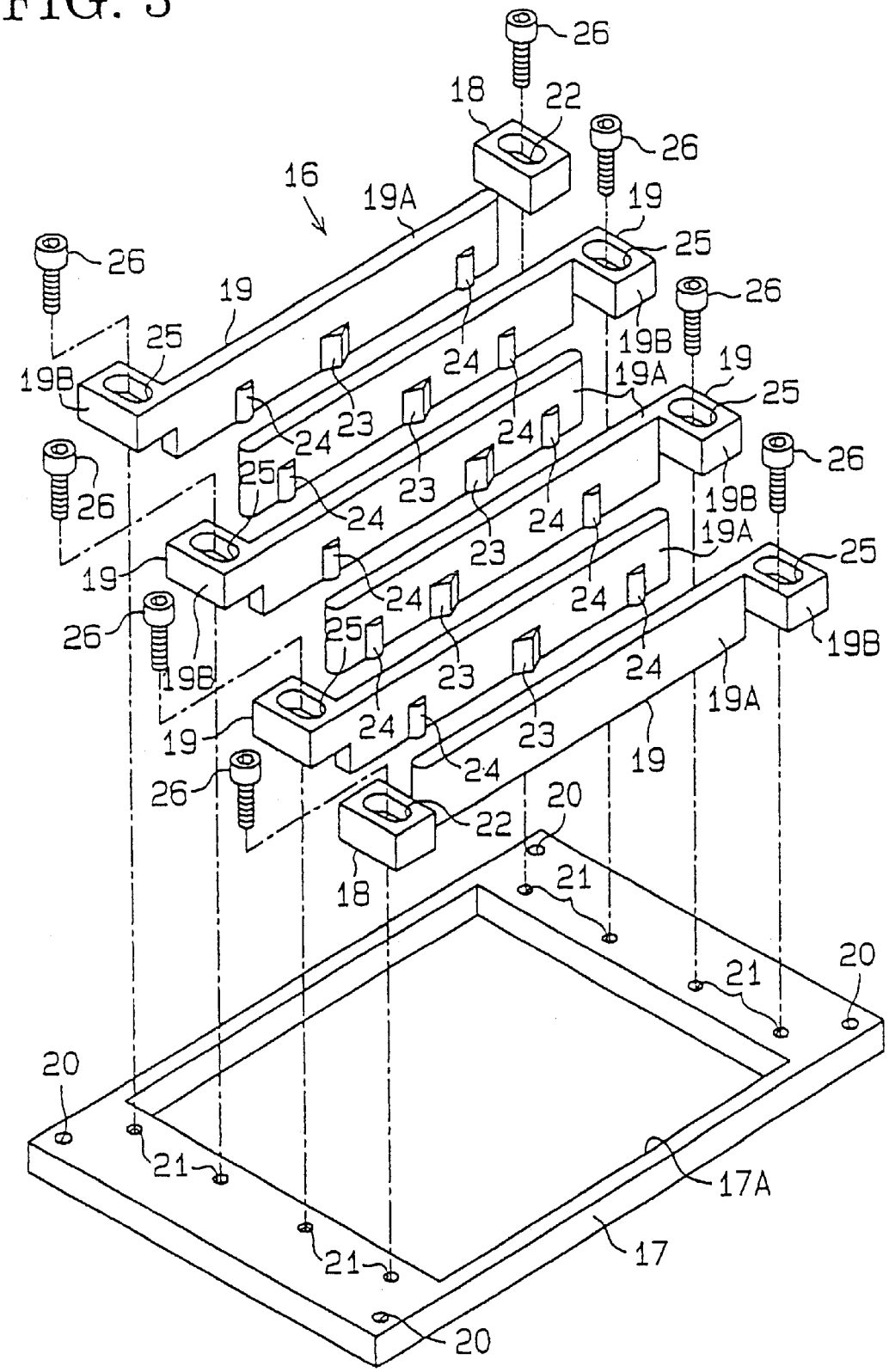
FIG. 3 is an exploded perspective view showing a state of the wire laying mold of the embodiment.
Figure 4:
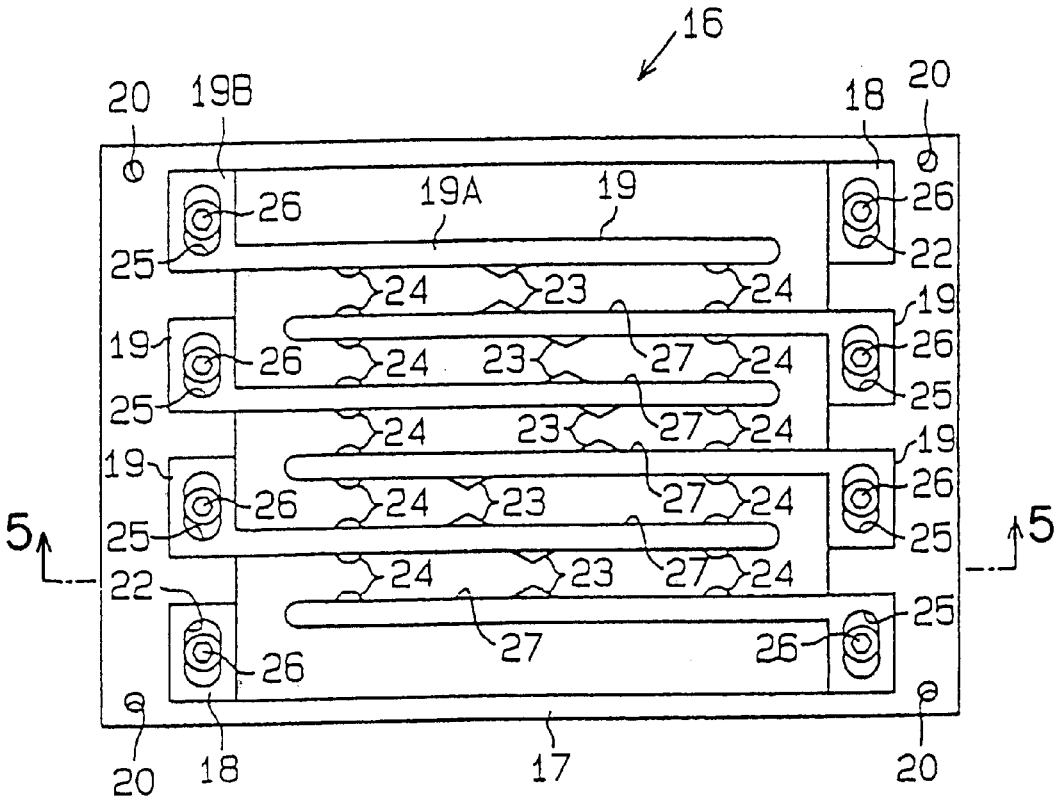
FIG. 4 is a plan view showing the state of the wire laying mold of the embodiment.
Figure 5:
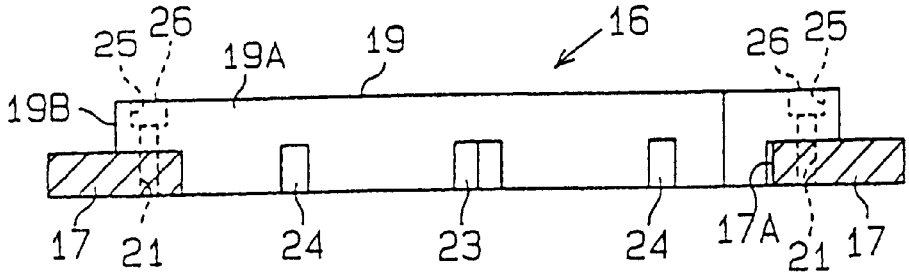
FIG. 5 is a section along 5—5 of FIG. 4.

As shown in FIGS. 3–5, the wire laying mold 16 is made e.g. of a metal material and is provided with a frame 17, two guide blocks 18 substantially in the form of a substantially rectangular parallelepiped and a plurality of (six in this embodiment) guide blocks 19.

The frame 17 is formed with a substantially rectangular through hole 17A in its center and with insertion holes 20 at its four corners. In the frame 17, a plurality of internally threaded holes 21 (eight in this embodiment) are formed along a pair of substantially opposite sides of the through hole 17A.

Each guide block 18 is provided with a stepped oblong or elongated hole 22. Each guide block 19 is substantially L-shaped and is comprised of an elongated main body 19A and a mount portion 19B that preferably is provided at one end of the main body 19A. A part of the main body 19A is accommodated in the through hole 17A and the lower surface thereof is substantially flush with that of the frame 17.

The main body 19A of each guide block 19 is formed with a breaking projection 23 in the form of a triangular prism in the middle of the main body 19A, and with supporting projections 24 in the form of a semicircular column at opposite longitudinal ends of the main body 19A. The projections 23, 24 have a height substantially corresponding to the thickness of the frame 17. Thus the upper surfaces of the projections 23, 24 serve as wire supporting surfaces in a wire laying process to be described later. The mount portion 19B of each guide block 19 also is formed with a stepped oblong or elongated hole 25 as in the guide blocks 18.

After the guide blocks 18, 19 are set in specified positions of the frame 17 as shown in FIGS. 3, 4 and 5, bolts 26 formed with hexagonal holes are screwed into the internally threaded holes 21 of the frame 17 through the oblong holes 22, 25 of the guide blocks 18, 19. Thus, the guide blocks 18, 19 are or can be fixed to the frame 17 by the bolts 26, thereby forming the wire laying mold 16. Guide holes 27 are defined inside the wire laying mold 16 or the through hole 17A of the frame 17 and are arranged in a zigzag manner by the plurality of guide blocks 19. The fixed positions of the guide blocks 18, 19 with respect to the frame 17 can be adjusted by the oblong holes 22, 25 of the guide blocks 18, 19 so as to correspond to the thickness of the laid wire.

Figure 6:
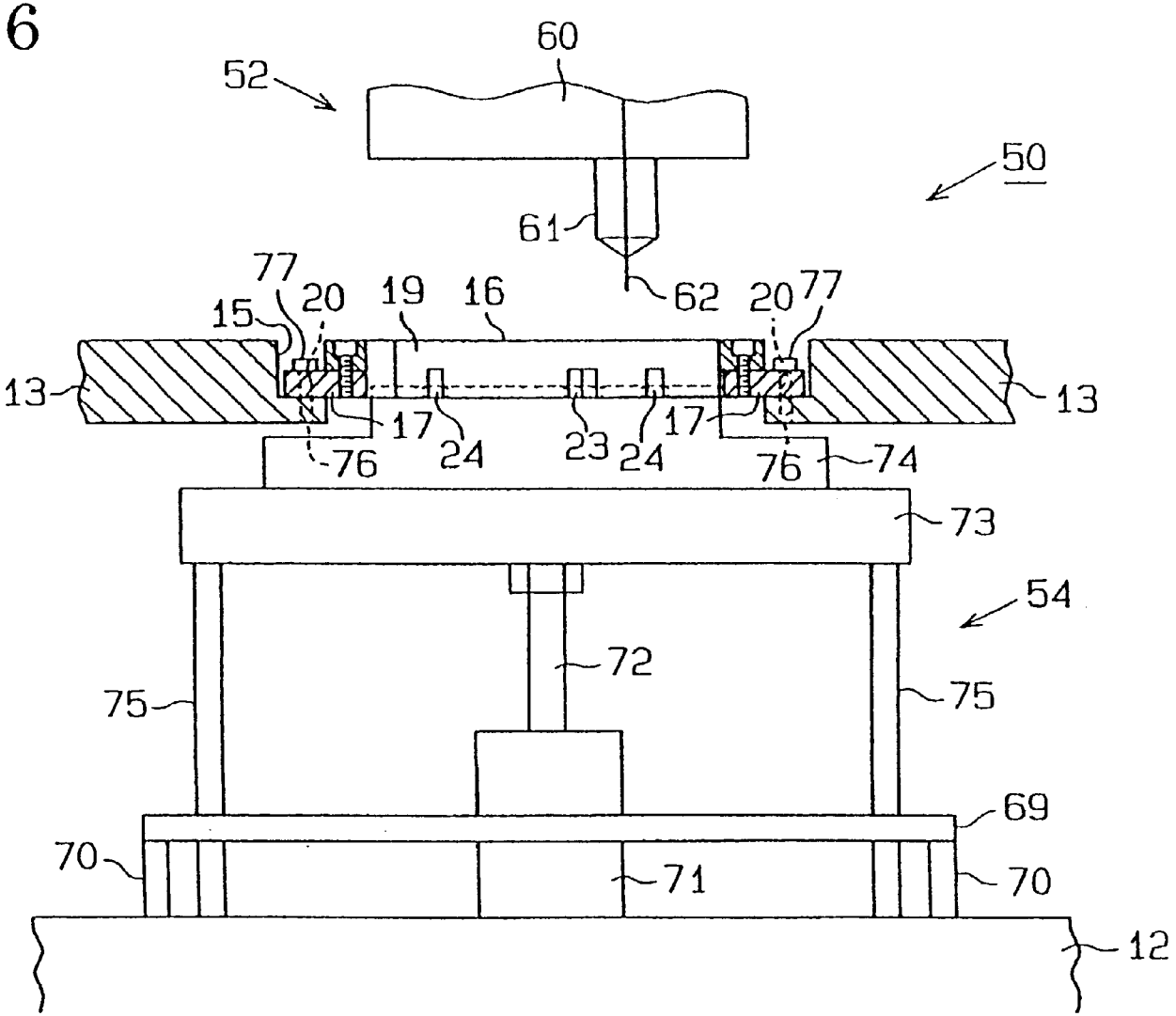
FIG. 6 is a section showing a state where an insulated wire is laid on the wire laying mold.

Before the wire laying process begins, the wire laying mold 16 is set a mounting hole 15 of the turntable 13 that does not correspond to the wire laying mechanism 50, the press cutting mechanism 100 and the press insulation-displacing mechanism 150. The wire laying mold 16 then is fixed to the turntable 13 by screwing bolts 77 into internally threaded holes 76 of the turntable 13 through the insertion holes 20 of the frame 17 as shown in FIG. 6.

This mechanism 50 is adapted to lay an insulated wire along the guide holes 27 of the wire laying mold 16 constructed as above. In particular, as shown in FIGS. 1, 2 and 6, the wire laying mechanism 50 includes a wire feeder 51 provided on the side of the base 12, a wire laying robot or mechanism 52 provided on the base 12, and a backup assembly 53 which is arranged on the side of the turntable opposite from the wire laying robot 52.

A reel 54 of the wire feeder 51 is mounted rotatably on the side of the base 12, and an insulated wire 62 to be laid is wound around the reel 54. A bracket 64 is provided with a guide tube 64A and is mounted atop a support column 63 that is secured to the base 12.

Figure 13:
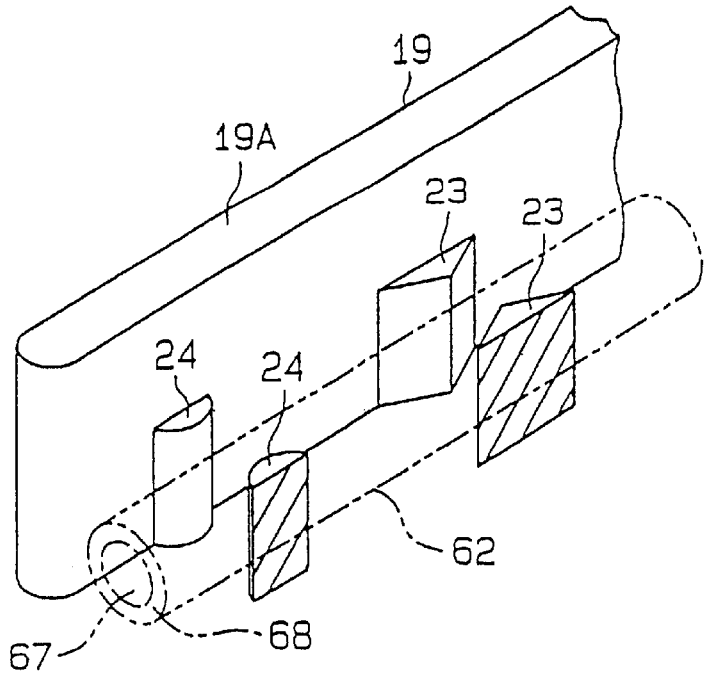
FIG. 13 is a perspective view diagrammatically showing a state where the insulated wire is pushed into a guide hole.

Two guide plates 65 made e.g. of a transparent synthetic resin are opposed to each other on the bracket 64, with the guide tube 64A located therebetween. A pair of guide rollers 66 are provided rotatably between bottom portions of the guide plates 65, and the outer surfaces thereof are substantially in contact with each other. The guide tube 64A, the guide plates 65 and the guide rollers 66 prevent the insulated wire 62 that is withdrawn from the reel 54 from being buckled or slanted due to its weight. As shown in FIG. 13, the insulated wire 62 preferably is formed by covering the outer surface of a core 67 made of a metal or other conductive material by an insulating coating 68. As shown in FIGS. 1, 2, and 6, the insulated wire 62 is withdrawn from the reel 54 by the guide rollers 66 and guidably fed to the wire laying robot 52 after passing the guide tube 64A, the guide plates 65 and the guide rollers 66 in this order.

The wire laying robot 52 preferably is a triaxial robot. A supporting element 56 extends in one substantially horizontal direction (direction normal to the plane of FIG. 2), and is provided atop a support column 55 that is fixed upright to the base 12. An X-direction movable element 57 is provided on the supporting element 56 for movement along one substantially horizontal direction (X-direction) along the supporting element 56. A Y-direction movable element 58 is provided on the X-direction movable element 57 for movement along a substantially horizontal direction (Y-direction) that preferably is substantially normal to the moving direction of the X-direction movable element 57 in a substantially horizontal plane. Further, a Z-direction movable element 59 is provided on the Y-direction movable element 58 for movement in a substantially vertical direction (Z-direction) that is normal to the moving directions of the X- and Y-direction movable elements 57, 58. The Z-direction movable element 59 is provided with a head 60 which is rotatable about a substantially vertical axis.

The head 60 is provided with a wire laying nozzle 61 that projects toward the turntable 13. The nozzle 61 holds the leading end of the insulated wire 62 fed by the guide rollers 66. The wire is laid on the wire laying mold 16 on the turntable 13 from above by the nozzle 61.

The wire is laid suitably on the wire laying mold 16 by the movements of the wire laying robot 52 along X-, Y- and Z-directions and the rotation of the head 60.

As shown in FIG. 6, a fixed table 69 of the backup assembly 54 is secured to the base 12 via preferably four support legs 70. An elevating cylinder 71 is secured to the base 12 while penetrating through the fixed table 69. A piston rod 72 of the cylinder 71 is substantially vertically projectable and retractable at a side toward the turntable 13. A support plate 73 is secured to the leading end of the piston rod 72, and a reinforcing block 74 is secured onto the support plate 73. Accordingly, the support plate 73 is or can be moved substantially upwardly and downwardly together with the reinforcing block 74 as the piston rod 72 of the cylinder 71 projects and retracts.

Four guide rods 75 extend toward the base 12, and are secured to the four corners of the support plate 73. The guide rods 75 are supported through the fixed table 69 to be slidable with respect thereto. As the support plate 73 is moved substantially upwardly and downwardly, the guide rods 75 are moved substantially upwardly and downwardly together so as to hold the support plate 73 constantly in a substantially horizontal orientation.

Figure 7:
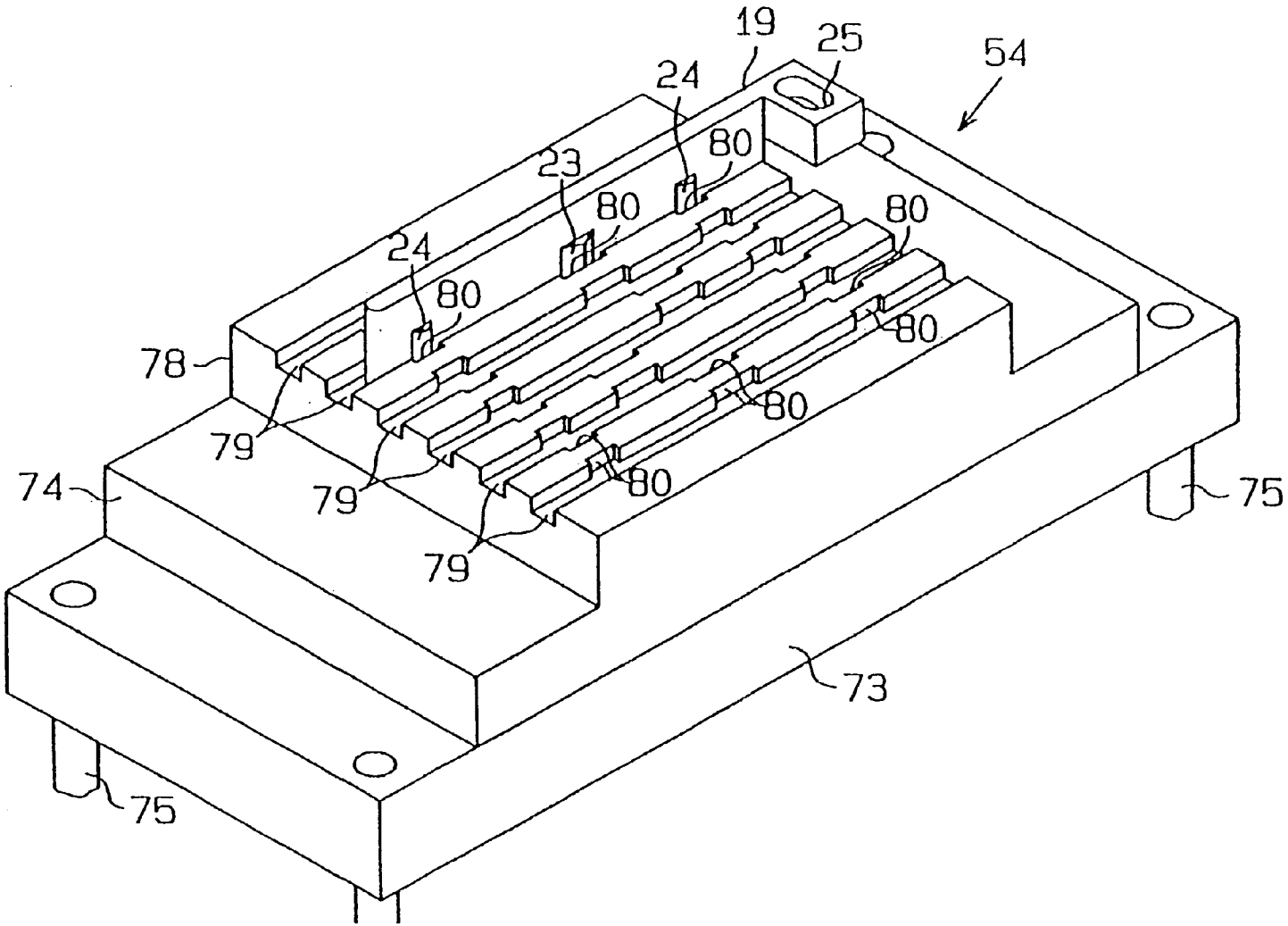
FIG. 7 is a perspective view diagrammatically showing a state where the wire laying mold is supported by a backup assembly.

FIG. 7 is a perspective view diagrammatically showing a state where the bottom surface of the wire laying mold 16 is supported by the backup assembly 53. In FIG. 7, a part of the wire laying mold, including the frame and guide blocks, is not shown. As shown in FIG. 7, a reinforcing portion 78 insertable into the through hole 17A of the frame 17 projects from the reinforcing block 74. On the upper surface of the reinforcing portion 78 are formed e.g. six accommodating grooves 79 extending parallel to the guide blocks 19. The accommodating grooves 79 are formed with one or more recesses 80 that bulge in directions substantially normal to the extension of the grooves 70. Accordingly, the guide blocks 19 are or can be accommodated in the accommodating grooves 79 and the breaking projections 23 or the supporting projection 24 are accommodated in the recesses 80 when the support plate 73 is moved substantially upwardly to insert an upper part of the reinforcing portion 78 of the reinforcing block 75 into the through hole 17A of the frame 17,. The width of the accommodating grooves 79 is set slightly larger than that of the guide blocks 19, so that the guide blocks 19 can be accommodated in the grooves 79 even if the fixed positions of the guide blocks 19 with respect to the frame 17 are adjusted finely.

Figure 8:
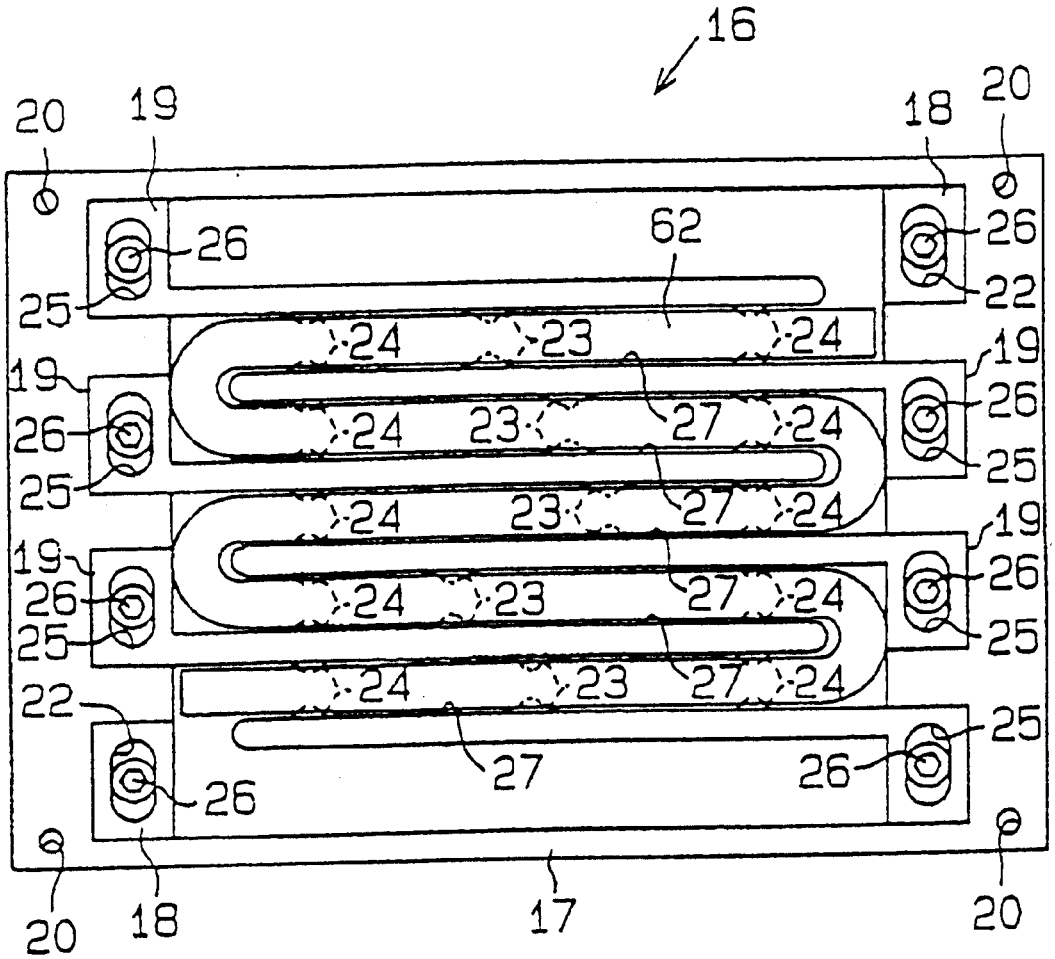
FIG. 8 is a plan view showing a state where the insulated wire is laid on the wire laying mold.

FIG. 8 is a plan view showing a state where the insulated wire is laid on the wire laying mold. As shown in FIG. 8, the insulated wire 62 is laid on top of the guide holes 27 of the wire laying mold 16, i.e. on top of the breaking projections 23 and the supporting projections 24 between the guide blocks 19, while being supported by the breaking projections 23 and the supporting projections 24. In other words, in the wire laying mold of the embodiment shown in FIG. 5, the insulated wire 62 is laid at a height higher than the breaking projections 23 and the supporting projections 24 of the guide blocks 19 by being placed on the breaking projections 23 and the supporting projections 24.

The wire laying process involves moving the reinforcing block 74 of the backup assembly 54 upwardly to support the bottom surface of the wire laying mold 16, and to reinforce the strength of the wire laying mold 16. The insulated wire 62 then is laid in the guide holes 27 of the wire laying mold 16 via the wire laying nozzle 61 from above the wire laying mold 16.

As shown in FIGS. 1, 2 and 6, upon the completion of the wire laying process, the rod 72 of the cylinder 71 of the backup assembly 54 is retracted to move the support plate 73 and the reinforcing block 74 downwardly.

Thereafter, before the press cutting process, the turntable 13 that fixedly accommodates the wire laying mold and the insulated wire 62 that has been laid therein is rotated to a specified position and stopped there for the press cutting process.

Figure 9:
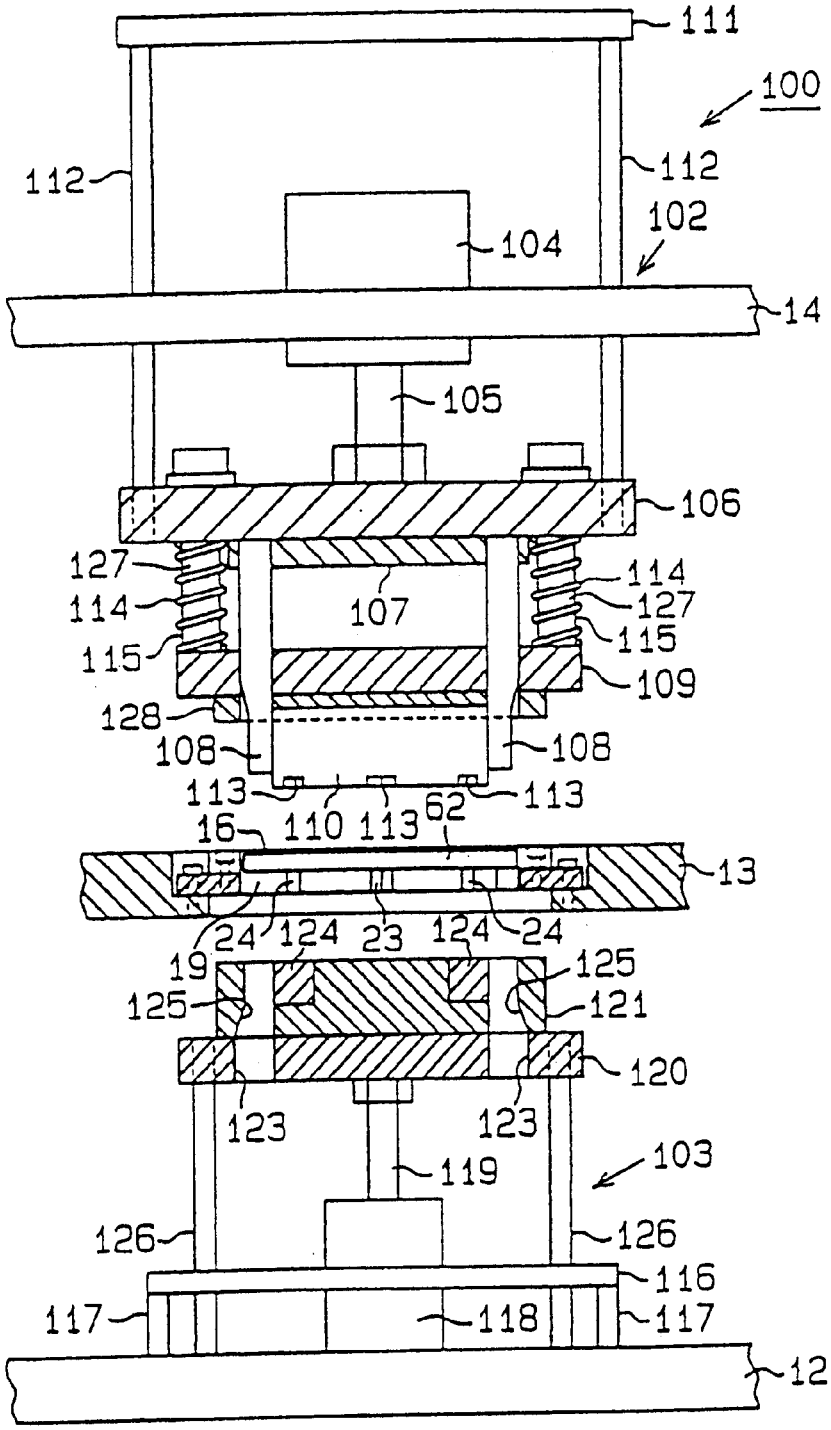
FIG. 9 is a section showing a state before a press cutting process is performed.
Figure 10:
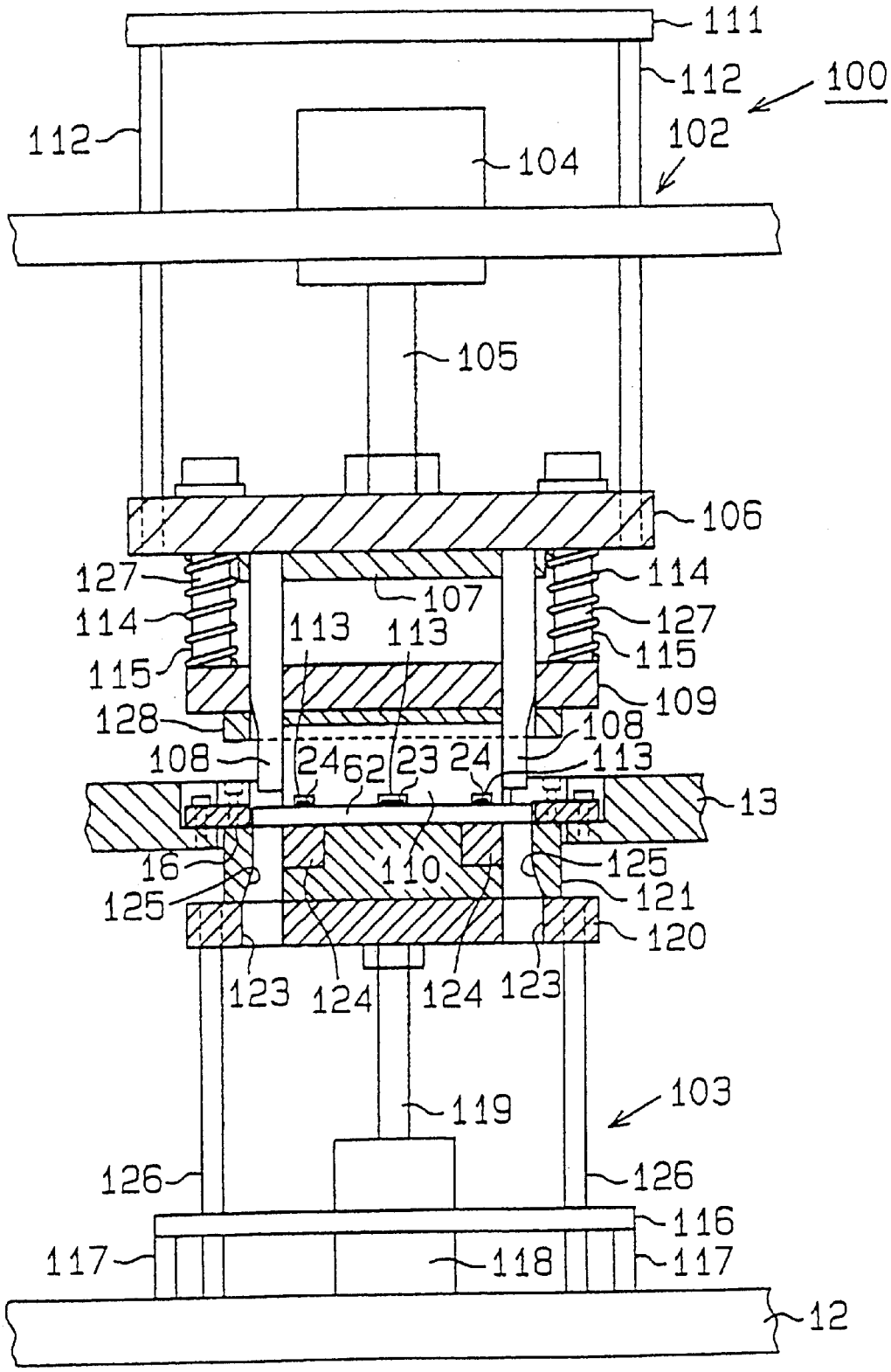
FIG. 10 is a section showing a state after pressing is applied to the insulated wire.

Next, the press cutting mechanism 100 is described with reference to FIG. 1, 2, 9 to 11 and 14. FIG. 9 is a section showing a state before the press cutting process is performed and FIG. 10 is a section showing a state where the press cutting process is applied to the insulated wire 62.

This press cutting mechanism 100 is adapted to cut unnecessary portions of the insulated wire laid on the wire laying mold 16 in the wire laying mechanism 50 and/or to straighten the remaining portions of the insulated wire 62 by pressing them.

As shown in FIGS. 1, 2, and 9, the press cutting mechanism 100 includes a press cutting assembly 102 placed on the support frame 14 and a backup assembly 103 arranged on the base 12 on the side of the turntable 13 substantially opposite from the press cutting assembly 102.

Figure 14:
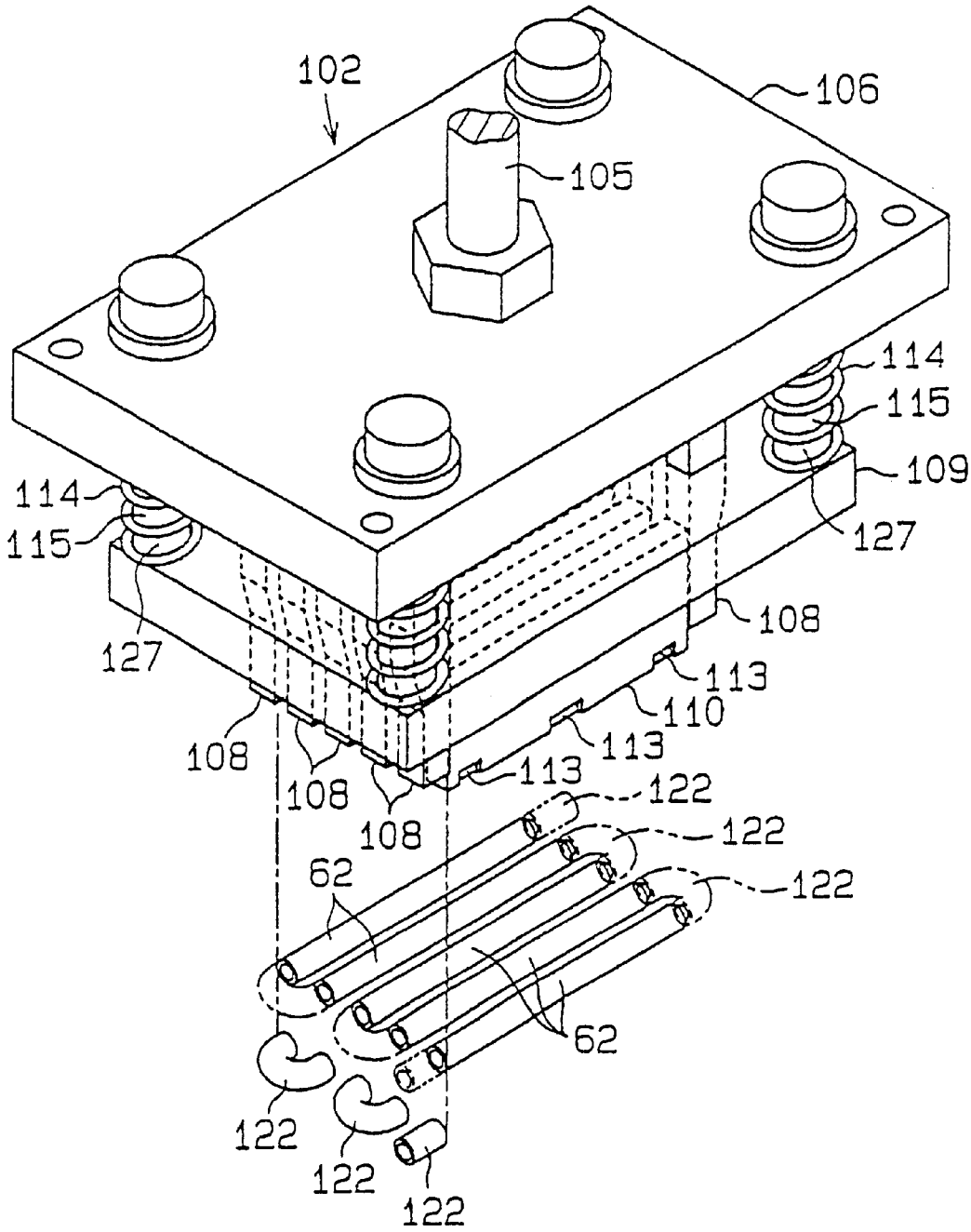
FIG. 14 is a perspective view diagrammatically showing a state of a part of the press cutting process.

A pressing cylinder 104 of the press cutting assembly 102 is secured while penetrating through the support frame 14, and a piston rod 105 thereof is projectable and retractable substantially upwardly and downwardly (along substantially vertical direction) at the side toward the turntable 13. A support plate 106 is secured to the leading end of the piston rod 105. Four support rods 127 are slidably inserted at the four corners of the support plate 106 and extend toward the turntable 13. A movable plate 109 is secured to the bottom ends of the support rods 127. As shown in FIG. 14, a plurality of pressing blocks 110 are secured to the bottom surface of the movable plate 109 via a mount plate 128 and function as a wire straightening mechanism. The number of the pressing blocks 110 preferably corresponds to the number of guide holes 27 formed in the wire laying mold 16.

Further, a spring 114 is mounted on each support rod 127 between the support plate 106 and the movable plate 109, thereby forming a damper 115. Accordingly, the biasing force of the springs 114 holds the movable plate 109 in a position spaced away from the support plate 106 by the length of the support rods 127.

A plurality of pairs of upper blades 108 are secured to the lower surface of the support plate 106 via a mount plate 107. One pair of upper blades 108 are provided for each pressing block 110, and the respective upper blades 108 slidably penetrate through the movable plate 109 and the mount plate 128 while being slidable to lateral end surfaces of the respective pressing blocks 110. It should be noted that the upper blades 108 are dimensioned such that their bottom ends constantly are located above the bottom surfaces of the pressing blocks 110.

Four guide rods 112 are secured at four corners of the support plate 106 and extend toward the support frame 14. The guide rods 112 slidably penetrate through the support frame 14, and a restricting plate 111 is secured to the leading ends of the respective guide rods 112 above the support frame 14. The guide rods 112 are moved substantially upwardly and downwardly together with the support frame 106 as the support plate 106 is moved substantially upwardly and downwardly, thereby constantly holding the support plate 106 in a preferably substantially horizontal orientation.

As the piston rod 105 of the pressing cylinder 104 projects or retracts along a substantially vertical direction, the support plate 106, the movable plate 109, the upper blades 108, the pressing blocks 110, the guide rods 112 and the restricting plate 111, etc. are moved in the same direction of the piston rod 105.

Recesses 113 are formed at the bottom ends of the respective pressing block 110 and correspond to the breaking projections 23 and the support projections 24 of the guide blocks 19. During the press cutting, the breaking projections 23 or the support projections 24 are fitted into the recesses 113. By pressing the pressing blocks 110 against the insulated wire 62, the buckle and twist of the insulated wire 62 can be straightened. Dampers 115 are provided between the support plate 106 and the fixed plate 109 and include the springs 114, which substantially suppress impacts during the press cutting.

A fixed table 116 of the backup assembly 103 is fixed to the base 12 via e.g. four support plates 117. An elevating cylinder 118 is secured to the base 12 while penetrating through the fixed table 116. A piston rod 119 of the elevating cylinder 118 is projectable and retractable substantially upwardly and downwardly (along substantially vertical direction) at the side toward the turntable 13. A support plate 120 is secured to the leading end of the piston rod 119. The support plate 120 is formed with discharge holes 123 for discharging scrap pieces 122 (see FIG. 11) of the insulated wire 62.

A reinforcing block 121 is secured onto the support plate 120. Accordingly, the support plate 120 (movable block) is moved substantially upwardly and downwardly together with the reinforcing block 121 as the piston rod 119 of the elevating cylinder 118 projects and retracts.

Four guide rods 126 are secured at four corners of the support plate 120 and extend toward the base 12. The guide rods 126 are supported slidably through the fixed table 116. The guide rods 126 are moved substantially upwardly and downwardly together with the support plate 120 as the support plate 120 is moved substantially upwardly and downwardly, thereby constantly holding the support plate 120 substantially horizontally.

The reinforcing block 121 is insertable into the through hole 17A of the frame 17. Lower blades 124 substantially corresponding to the pairs of upper blades 108 are buried in the reinforcing block 121. Discharge holes 125 are formed in positions of the reinforcing block 121 adjacent to the lower blade 124, and which can communicate with the discharge holes 123. It should be noted that unillustrated accommodating grooves and recesses which are similar to the accommodating grooves 79 and the recesses 80 of the reinforcing block 74 in the aforementioned wire laying mechanism 50 also are formed in the upper surface of the reinforcing block 121.

As shown in FIG. 10, the press cutting process is performed as follows. First, the strength of the wire laying mold 16 is reinforced by moving the reinforcing block 121 of the backup assembly 103 substantially upwardly by the piston rod 119 of the elevating cylinder 118 in such a manner as to support the bottom surface of the wire laying mold 16. The pressing blocks 110 and the like then are moved substantially downwardly by the piston rod 105 of the pressing cylinder 104 of the press cutting assembly 102. The insulated wire 62 laid on the breaking projections 23 and the support projections 24 is pushed by the pressing blocks 110 moving substantially downwardly until it comes into contact with the upper surface of the reinforcing block 121 while contacting the breaking projections 23 and the support projections 24. In this case, the insulated wire 62 is pressed by the pressing blocks 110 and is straightened with the breaking projections 23 and the support projections 24 accommodated in the corresponding recesses 113 of the pressing blocks 110.

Figure 12:
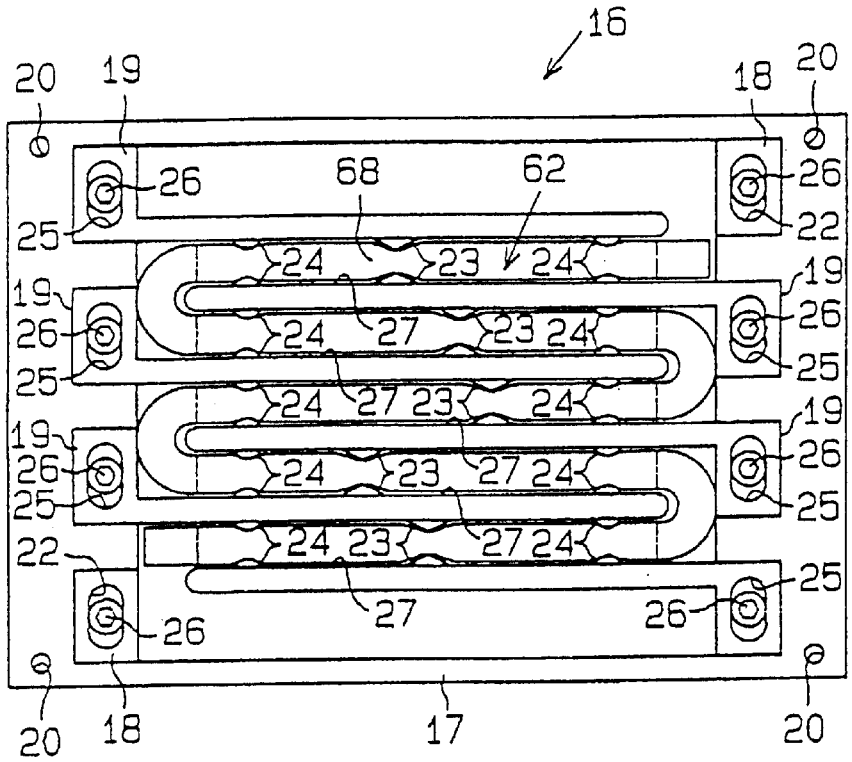
FIG. 12 is a plan view showing a state where the insulated wire is pushed against the wire laying mold.

FIG. 12 is a plan view showing a state where the insulated wire 62 is pushed into the wire laying mold 16, and FIG. 13 is a perspective view diagrammatically showing a state where the insulated wire 62 is pushed into the guide holes 27. As shown in FIGS. 12 and 13, when the insulated wire 62 is pushed by the pressing blocks 110, the insulated wire 62 is tightly held by the support projections 24 and has its insulating coating 68 cut substantially open by the leading ends of the breaking projections 23 in contact therewith. In other words, the insulated wire 62 can be stably cut by being tightly held by the support projections 24, and the press insulation-displacing process can be performed securely and easily because the insulating coating 68 of the insulated wire 62 is cut open.

Figure 11:
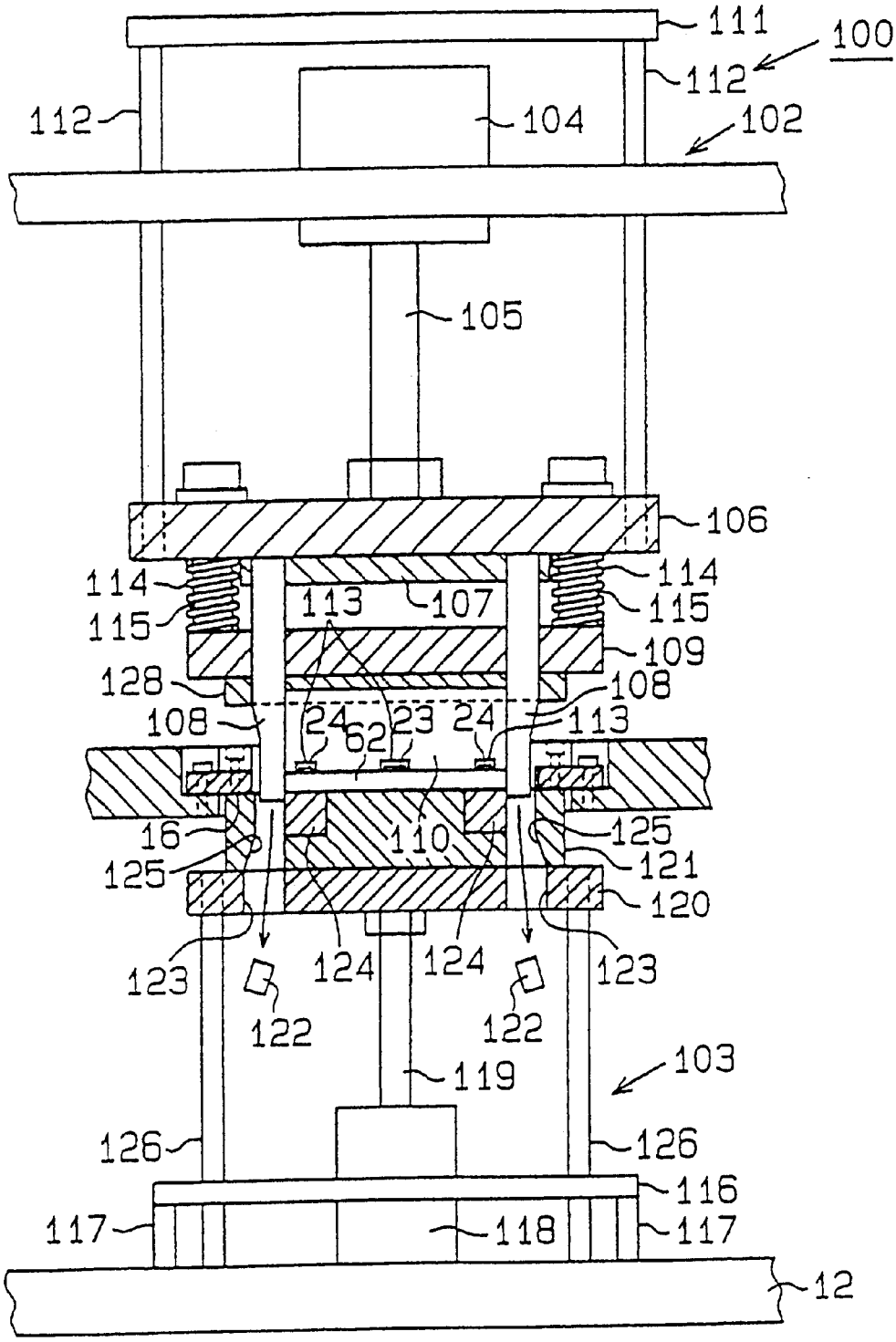
FIG. 11 is a section showing a state where the press cutting process is being performed.

FIG. 11 is a section showing a state where the press cutting process is performed, and FIG. 14 is a perspective view diagrammatically showing a state of a part of the press cutting process.

As shown in FIGS. 11 and 14, after the insulated wire 62 is pressed between the breaking projections 23 and between the support projections 24 by the pressing blocks 110, the upper blades 108 are moved substantially downwardly. The unnecessary portions of the insulated wire 62 (opposite ends and corner portions of the insulated wire 62 indicated by phantom line in FIG. 12) are cut by the upper and lower blades 108 and 124, thereby becoming scrap pieces 122, which then are discharged through the discharge holes 125 and 123 of the reinforcing block 121 and the movable block 120. In this case, the unnecessary portions of the insulated wire 62 are cut simultaneously, and impacts during the press cutting are suppressed by the dampers 115 including the springs 114.

After the completion of the press cutting process, the upper blades 108, the pressing blocks 110, the fixed plate 109, the holding plate 107, the support plate 106, the support columns 112, the restricting plate 111, and the like are moved upwardly by the rod 105 of the cylinder 104 in the press cutting assembly 102, whereas the movable block 120, the reinforcing block 121, and the like are moved downwardly by the rod 119 of the cylinder 118 of the backup assembly 103.

Thereafter, the turntable 13 carrying the wire laying mold 16 to which the press cutting process has been applied is rotated to a specified position before the press insulation-displacing process is performed so as to stop the wire laying mold 16 containing the cut insulated wire 62 at a specified position where the press insulation-displacing process is performed.

Figure 15:
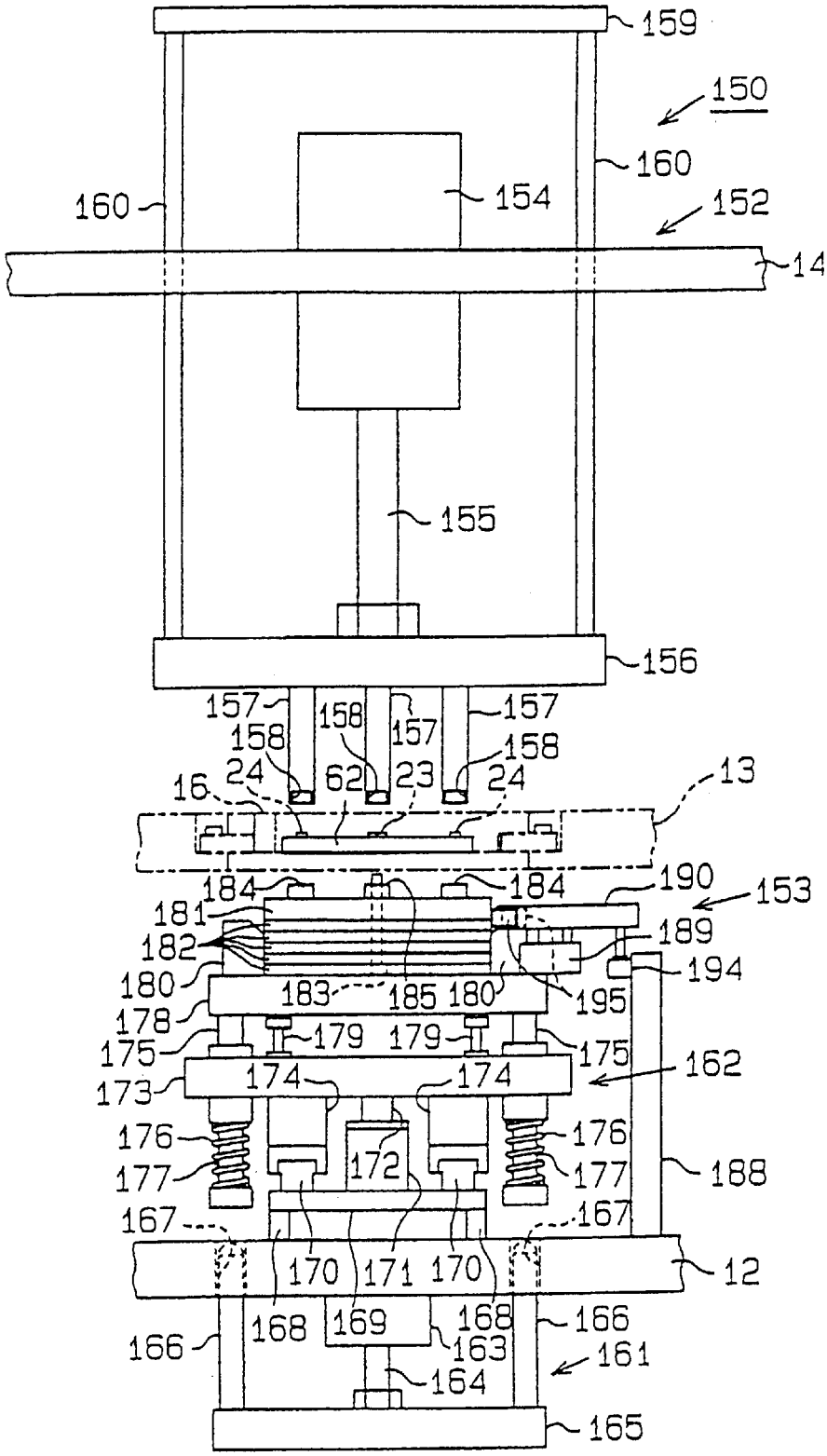
FIG. 15 is a plan view partly in section showing a state before a press insulation-displacing process is performed.

Next, the press insulation-displacing mechanism 150 is described with reference to FIGS. 1, 2, 15 to 20. FIG. 15 is a front view partly in section showing a state before the press insulation-displacing process is performed. This press insulation-displacing mechanism 150 is adapted to transfer the wires of a specified layout pattern in the wire laying mold 16 to which the press cutting process has been applied in the press cutting mechanism 100 to a work or work piece.

As shown in FIGS. 1, 2 and 15, the press insulation-displacing mechanism 150 includes a press insulation-displacing assembly 152 that is placed on the support frame 14 and a backup assembly 153 that is provided on the base 12 on the side of the turntable 13 substantially opposite from the press insulation-displacing assembly 152.

A pressing cylinder 154 of the press insulation-displacing assembly 152 is secured while penetrating through the support frame 14, and a piston rod 155 thereof is projectable and retractable substantially upwardly and downwardly (along a substantially vertical direction) at the side toward the turntable 13. A support plate 156 is secured to the leading end of the piston rod 155. A plurality of pushing pins 157 extend downwardly from the support plate 156. These pushing pins 157 are provided in positions corresponding to the breaking projections 23 and the support projections 24 of the wire laying mold 16. At the leading end of each pushing pin 157 are formed a pair of recesses 158 which face the main portion 19*a* of the corresponding guide block 19. It should be noted that the leading end of each pushing portion 157 is formed to have a substantially T-shaped cross section, and the amount the pushing portion 157 pushes the wire is controlled by this configuration (see FIG. 20).

At e.g. four corners of the support plate 156 are secured e.g. four guide rods 160 extending toward the support frame 14. These guide rods 160 slidably penetrate through the support frame 14, and a restricting plate or rod or pin 159 is secured to the leading ends of the respective guide rods 160 above the support frame 14. When the support plate 156 is moved upwardly and downwardly, the guide rods 160 are moved in the same direction together therewith so as to constantly hold the support plate 156 in a substantially horizontal orientation.

As the piston rod 155 of the pressing cylinder 154 projects and retracts, the support plate 156, the pushing pins 157, the guide rods 160, the restricting plate 159, and the like are moved integrally substantially upwardly and downwardly.

The backup assembly 153 includes an elevating section 161 provided inside the base 12 and a conveying section 162 provided on the base 12.

A cylinder 163 of the elevating section 161 is secured to the inner surface of the base 12. A rod 164 of the cylinder 163 is secured to an elevating plate 165 to project and retract along a substantially vertical direction. Four push-up portions 166 extend substantially upwardly from the elevating plate 165. These push-up portions 166 project substantially upwardly from the base 12 through holes 167 formed in the base 12. In other words, the elevating plate 165 and the push-up portions 166 are moved substantially upwardly and downwardly together by the upward and downward movements of the rods 164 of the cylinder 163.

Figure 16:
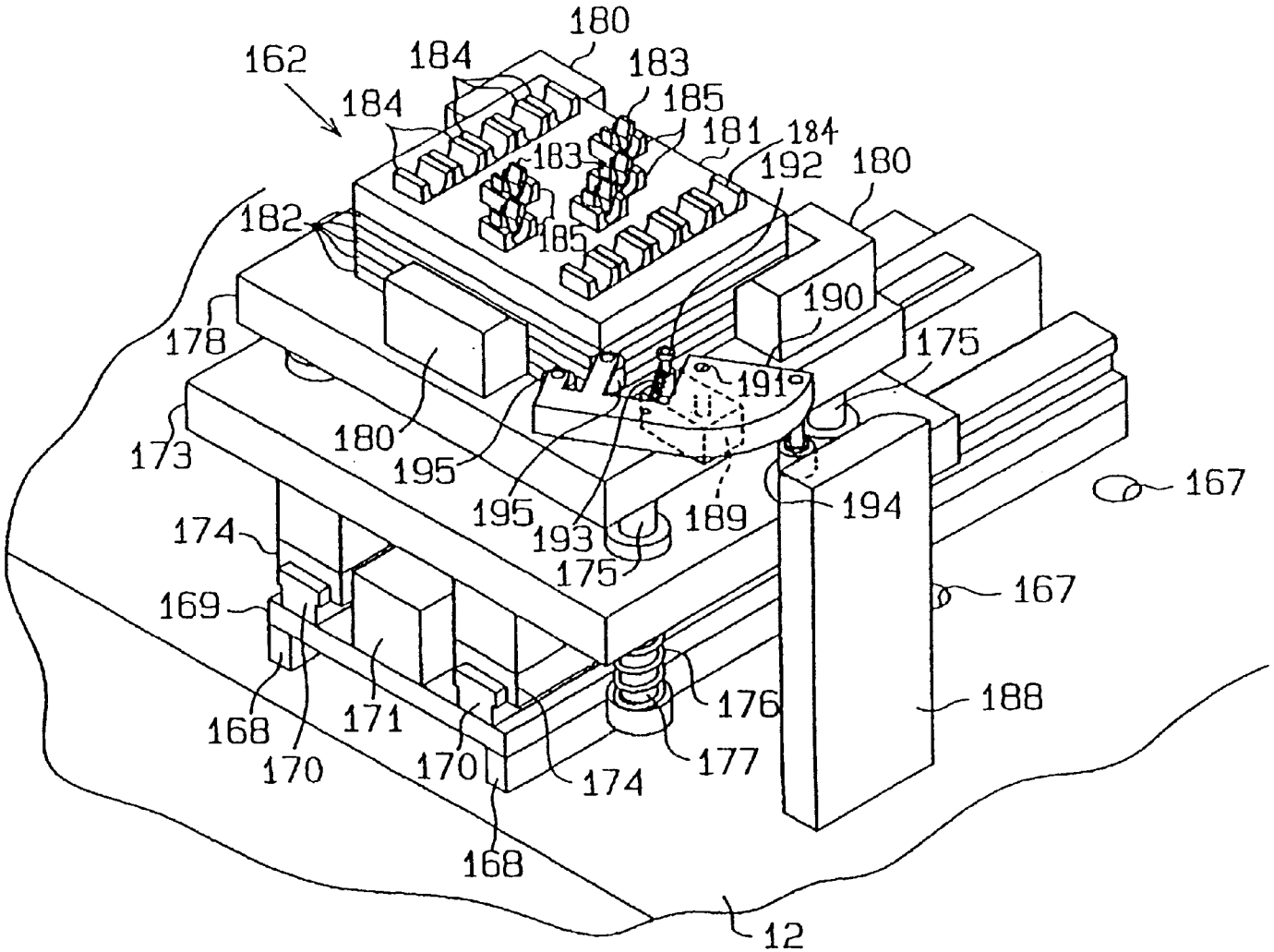
FIG. 16 is a perspective view showing a state before the position of a work is fixed.

FIG. 16 is a perspective view showing a state before the position of the work is fixed. As shown in FIGS. 1, 2, 15 and 16, a pair of substantially parallel guide rails 170 extend in radial direction of the turntable 13 and are provided on the upper surface of a fixed table 169. The fixed table 169 has fixed legs 168 secured to the base 12 in the conveying section 162. A rod-less cylinder 171 is provided preferably substantially parallel with the guide rails 170 on the fixed table 169 between the guide rails 170, and a conveying table 173 is secured to a coupling portion 172 above the rod-less cylinder 171. Sliders 174 are provided on the lower surface of the conveying table 173 corresponding to the guide rails 170 so as to make the conveying table 173 reciprocatingly movable on the guide rails 170. In other words, as the coupling portion 172 is substantially horizontally moved by actuating the rod-less cylinder 171, the sliders 174 and the conveying table 173 are moved together on the guide rails 170 in the same substantially horizontal direction as the coupling portion 172.

Four support columns 175 are provided at four corners of the conveying table 173 and slidably penetrate through the conveying table 173 along the substantially vertical direction. Dampers 177 including springs 176 are provided below the support columns 175, and the support columns 175 are pushed up by the push-up portions 166. These dampers 177 suppress impacts produced when the support columns 175 are pushed up by the push-up portions 166. An accommodating table 178 is secured to the upper ends of the four support columns 175, and have its substantially downward movement restricted by a pair of stoppers 179 provided on the upper surface of the conveying table 173.

Three positioning blocks 180 are fixed on the accommodating table 178 at specified intervals. A work piece 181 is or can be accommodated and partly positioned between these positioning blocks 180.

Figure 19:
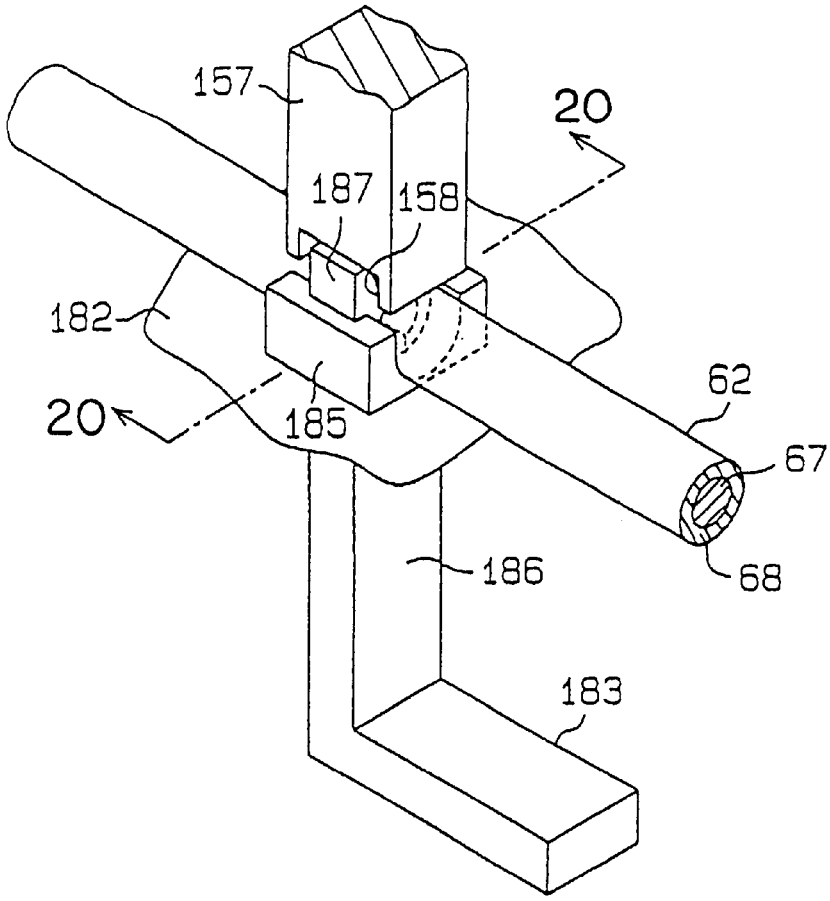
FIG. 19 is a perspective view diagrammatically showing a state where the insulated wire is fastened to an insulation-displacing piece.
Figure 20:
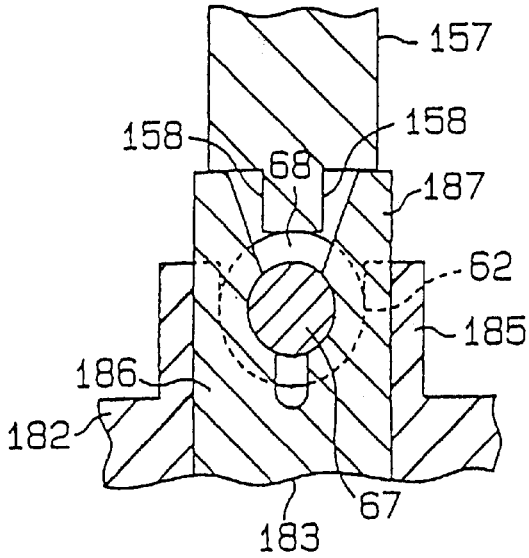
FIG. 20 is a section along 20—20 of FIG. 19.

The work piece 181 includes a plurality of insulating substrates 182 placed one over another, a busbar 183 fixedly arranged in the insulating substrates 182, substantially U-shaped wire mounts 184 and busbar mounts 185 projecting from the upper surface of the uppermost substrate 182. As shown in FIGS. 19 and 20, the busbar 183 has tab portions 186 formed e.g. by bending portions of the busbar 183, and an insulation-displacing piece or crimping piece 187 for receiving the insulated wire 62 is formed at the leading end of the tab portion 186.

As shown in FIGS. 1, 2, 15 and 16, a cam 188 is provided on the base 12 on the side of the fixed table 169. The upper end of the cam 188 is located above the accommodating table 178. A support block 189 projects toward the cam 188 on the side of the accommodating table 178 substantially corresponding to the cam 188. A substantially vertically extending support shaft 191 projects from the support block 189, and a cam follower 190 is rotatably supported on the support shaft 191 in substantially horizontal direction. A projecting portion 192 and the cam follower 190 of the support block 189 are coupled by a spring 193, which biases the cam follower 190 to rotate counterclockwise or towards the work piece 181 about the support shaft 191. The cam follower 190 is provided with a follower roller 194 which is movably in contact with the cam 188 at a position on the side of the accommodating table 178. Further, the cam follower 190 is provided with two support rollers 195 capable of supporting two surfaces of the work piece 181 at the side of the support shaft 191 opposite from the follower roller 194.

In the state where the conveying table 173 is moved toward a set position of the work piece 181 along the guide rails 170 and the follower roller 194 of the cam follower 190 is in contact with cam 188, the support rollers 195 are held by being spaced apart from the work piece 181. Conversely, in the state where the conveying table 173 is moved toward the turntable 13 along the guide rails 170 and the follower roller 195 of the cam follower 190 is spaced away from the cam 188, the support rollers 195 are held substantially in contact with the work 181. At this time, the two support rollers 195 are pressed against the two surfaces of the work piece 181 by the biasing force of the spring 193, with the result that the work piece 181, that had been partly positioned, becomes fully positioned and/or held by the support rollers 195 and the position blocks 180.

Figure 17:
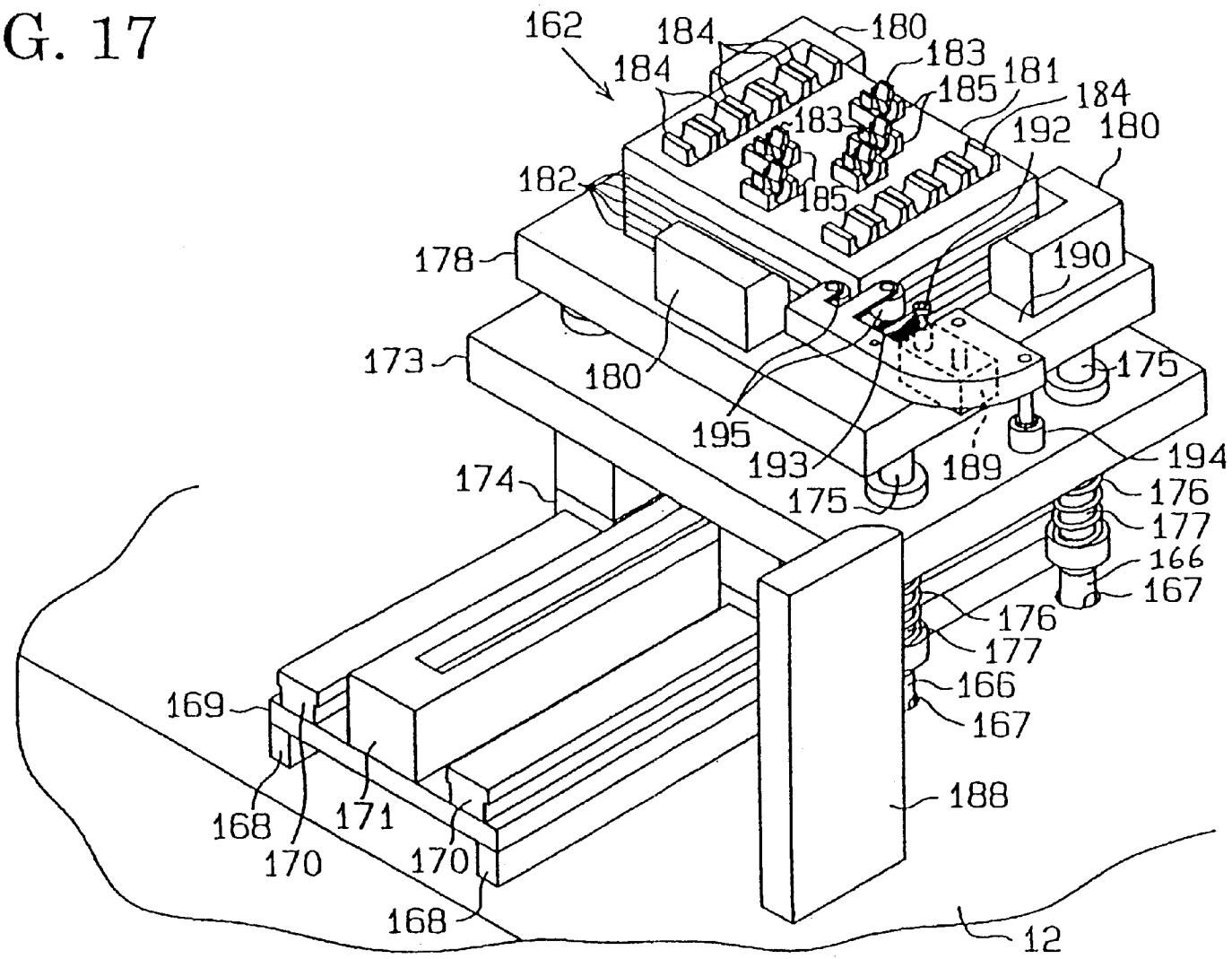
FIG. 17 is a perspective view showing a state where the position of the work is fixed.
Figure 18:
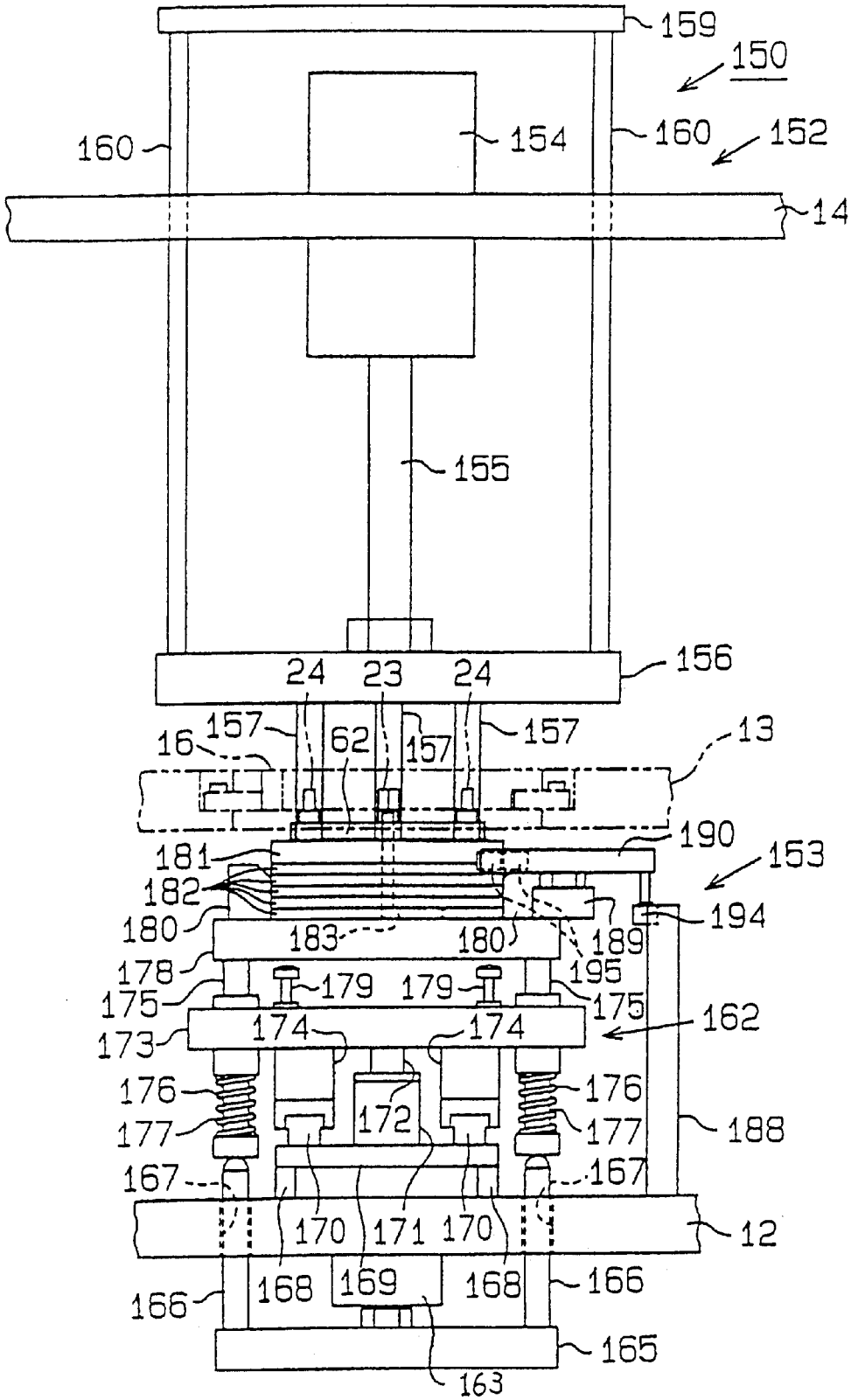
FIG. 18 is a plan view partly in section showing a state after the press insulation-displacing process is performed.

FIG. 17 is a perspective view showing a state where the position of the work is fixed, and FIG. 18 is a front view partly in section showing a state after the press insulation-displacing process has been performed.

As shown in FIGS. 17 and 18, the conveying table 173 is moved along the guide rails 170 by the substantially horizontal (conveying direction) movement of the coupling portion 172 of the rod-less cylinder 171, thereby conveying the work 181 on the accommodating table 178 to a specified position (conveyance position) where the press insulation-displacing process is or can be performed. In this case, the support rollers 195 of the cam follower 190 are held in contact with the work piece 181 when the follower roller 195 of the cam follower 190 are spaced away from the cam 188. In other words, when the two support rollers 195 are pressed against the two surfaces of the work piece 181 by the biasing force of the spring 193, the partly positioned work 181 is held in a specified position (where the press insulation-displacing process is normally performed) by the support rollers 195 and the positioning blocks 180.

Then, the push-up portions 166 of the elevating section 161 are caused to project substantially upwardly by the rod 164 through the through holes 167 of the base 12, thereby pushing the support columns 175 up. At this time, the accommodating table 178, i.e. the work piece 181, is held at a specified height by the support columns 175, with the result that the accommodating table 178 is spaced apart from the stoppers 179. In this way, the work piece 181 is positioned from below with respect to the wire laying mold 16 that is fixed to the turntable 13 to which the press insulation-displacing process is to be performed. In this case, the breaking projections 23 of the wire laying mold 16 correspond to the busbar mounts 185 of the work piece 81, while the support projections 24 thereof correspond to the wire mounts 184.

Thereafter, the pushing portions 157 of the press insulation-displacing assembly 155 are moved substantially downwardly by the movement of the rod 155, and the remaining portions of the insulated wire 62, after cutting, are pushed by the pushing portions 157 for transfer from the wire laying mold 16 to the work piece 181 that is located below. In this case, the insulated wire 62 that is held tightly in the wire laying mold 16 is transferred to a specified position of the work piece 81 while the layout pattern thereof is maintained, thereby being laid on the work piece 81.

FIG. 19 is a perspective view diagrammatically showing a state where the insulated wire 62 is connected with the insulation-displacing piece 187, and FIG. 20 is a section along B—B of FIG. 19. As shown in FIGS. 19 and 20, the insulated wire 62 is accommodated in the insulation-displacing piece 187 of the busbar 183 that is placed on the busbar mount 185 of the insulating substrate 182 while being pushed by the pushing portion 157. In this case, the insulating coating 68 is torn or is made easy to tear by the breaking projections 23 of the guide block 19 in a portion of the insulated wire 62 pressed into the insulation-displacing piece 187. Accordingly, the insulating coating 68 of the insulated wire 62 is torn easily and securely by the pushing force of the insulated wire 62 with respect to the insulation-displacing piece 187 during the press insulation-displacing process. As a result, the core 67 of the insulated wire 62 and the insulation-displacing piece 187 of the busbar 183 are or can be electrically connected.

Figure 21:
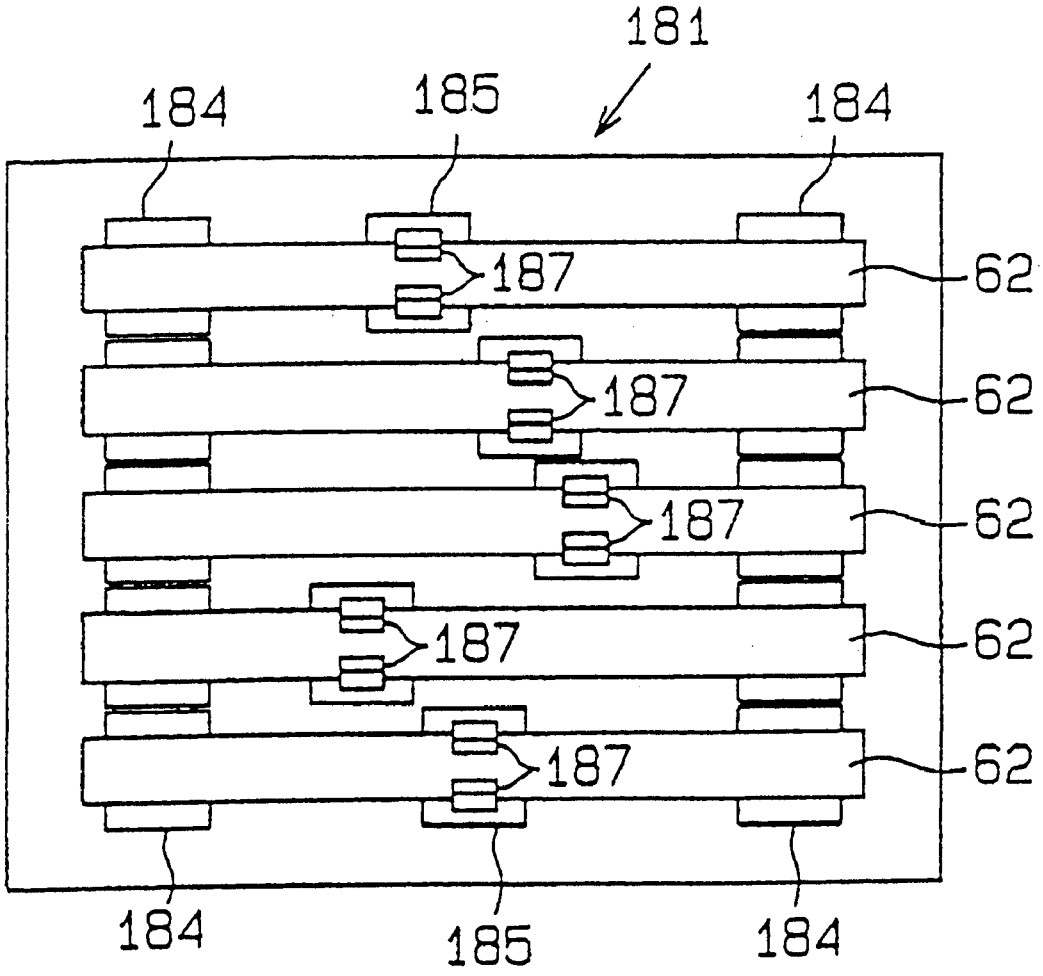
FIG. 21 is a plan view grammatically showing state where the insulated wires are fastened to the work.

FIG. 21 is a plan view diagrammatically showing a state where the insulated wire 62 is laid on the work piece 181. As shown in FIG. 21, when the press insulation-displacing process is performed, five pieces of the insulated wire 62 are laid on the work piece 181. In other words, each piece of the insulated wire 62 has its opposite ends supported by the wire mounts 184 and has its intermediate portion supported by the insulation-displacing piece 187 that is located between the wire mounts 184, thereby forming a layout pattern on the work 181.

Upon the completion of the press insulation-displacing process, the pushing portions 157, the support plate 156, and the like are moved substantially upward by the rod 155 of the cylinder 154 of the press insulation-displacing assembly 152 in a state as shown in FIGS. 15 and 16. Thereafter, after the push-up portions 166 are moved substantially downwardly by the rod 164 of the cylinder 163 of the elevating section 161, the conveying table 173 is moved from the conveyance position to a retracted position (where the work 181 is placed on the accommodating table 178 while being partly positioned) along the guide rails 170 by the coupling portion 172 of the rod-less cylinder 171 of the conveying section 162. Finally, the work piece 181, in a state as shown in FIG. 21, is taken out from the positioning blocks 180 on the accommodating table 178 of the conveying section 162.

As described above, the wire laying process, the press cutting process and the press insulation-displacing process are successively performed by the wire laying apparatus 11 according to this embodiment.

According to the embodiment described in detail above, following effects can be obtained.

In the wire laying mold 16 of this embodiment, the fixed positions of the guide blocks 18 and 19 can be adjusted finely with respect to the frame 17 by the oblong holes 22 and 25 of the guide blocks 18 and 19. Thus, the wire laying mold 16 can be applied in a wider range by being able to accommodate different positions and patterns of the insulated wire 62 laid in the guide holes 27 of the wire laying mold 16.

Since the wire laying mold 16 is comprised of separate members including the frame 17 and guide blocks 18 and 19 and the like, it is sufficient to replace at least one of the frame 17 and the guide blocks 18 and 19 of the wire laying mold 16 when the wire laying mold 16 needs to be replaced. This leads to a reduced exchange cost for the wire laying mold 16 and accordingly a reduction in production costs.

In the foregoing embodiment, the guide blocks 18 and 19 are fixed to the frame 19 by the bolts 26 formed with hexagonal holes. Thus, the guide blocks 18 and 19 can be attached and detached easily to and from the frame 17 only by screwing in and out the bolts 26. Further, when the wire laying mold 16 is formed, the guide blocks 18 and 19 can be set easily and securely in specified positions with respect to the frame 17.

In the foregoing embodiment, the breaking projections 23 substantially in the form of a triangular prisms are formed in specified bottom positions of the guide blocks 19 of the wire laying mold 16 along its longitudinal direction. Since the insulated wire 62 is pushed to the upper surface of the reinforcing block 121 while being held in contact with the breaking projections 23 when the press cutting process is performed, the insulating coating 68 of insulated wires 62 can be torn or be made easy to tear by the leading ends of the breaking projections 23. As a result, the insulating coating 68 of the insulated wires 62 can be torn easily and securely by the pressing force of the insulated wire 62 against the insulation-displacing piece 187 when the press insulation-displacing process is performed, and the core 67 of the insulated wire 62 and the insulation-displacing piece 187 of the busbar 183 can be securely electrically connected with each other.

In the foregoing embodiment, the breaking projections 23 substantially in the form of a triangular prism and the support projections 24 substantially in the form of a semicircular or rounded column are formed in specified bottom positions of the guide blocks 19 of the wire laying mold 16 along the longitudinal direction. Thus, the cut pieces of the insulated wire 62 can be held tightly by the support projections 24 in the wire laying mold 16 after the press cutting process, and portions thereof in contact with the leading ends of the breaking projections 23 can be tightly held by the breaking projections 23 with the insulated coatings 68 of the pieces of the insulated wires 62 torn or being made easy to tear. In this case, the pieces of the insulated wire 62 are prevented from dropping from the guide holes 27 of the wire laying mold 16 by being tightly held by the breaking projections 23 and the support projections 24.

In the foregoing embodiment, the bottom surface of the wire laying mold 16 is supported by the reinforcing block 74 of the backup assembly 54 when the wire laying process is performed. Thus, the strength of the wire laying mold 16 can be reinforced by the reinforcing block 74, and the wire laying process can be performed stably when the insulated wire 62 is laid in the guide holes 27 of the wire laying mold 16.

In the foregoing embodiment, when the wire laying process is performed, the insulated wire 62 is laid while being supported by the breaking projections 23 and the support projections 24 on the top of the guide holes 27, i.e. on the breaking projections 23 and the support projections 24 between the guide blocks 19. In this case, the insulated wire 62 can be laid while being placed on the breaking projections 23 and the support projections 24, and can be prevented from dropping down from the top of the guide holes of the wire laying mold 16.

In the foregoing embodiment, the bottom surface of the wire laying mold 16 is supported by the reinforcing block 121 of the backup assembly 103. Thus, the strength of the wire laying mold 16 can be reinforced by the reinforcing block 121, and the press cutting process can be performed stably when press cutting is applied to the insulated wire 62 placed on the wire laying mold 16.

In the foregoing embodiment, the insulated wire 62 is pressed by the pressing blocks 110 when the press cutting process is performed. Thus, the insulated wire 62 can be straightened by removing its buckle and twist by the pressing forces of the pressing blocks 110. Therefore, the insulated wire 62 can be held tightly by the breaking projections 23 and the support projections 24 of the wire laying mold 16 while being straightened.

In the foregoing embodiment, the unnecessary portions of the insulated wire 62 can be cut off simultaneously by the engagement of the plurality of upper blades 108 (10 in the foregoing embodiment) and a plurality of lower blades 124 (10 in the foregoing embodiment). In this case, portions of the insulated wire 62 in vicinity of the cut portions neither move up nor are displaced during the cutting since they are tightly held by the support projections 24, with the result that the unnecessary portions of the insulated wire 62 can be cut off stably and securely. Further, the remaining pieces of the insulated wire 62 can be held stably and tightly by the breaking projections 23 and the support projections 24.

In the foregoing embodiment, when the press cutting process is performed, the scrap pieces 122 of the insulated wire 62 can be discharged through the discharge holes 125 and 123 of the reinforcing block 121 and the movable block 120 at the same time they are produced by cutting the unnecessary portion of the insulated wire 62 off.

In the foregoing embodiment, when the press insulation-displacing process is performed, the conveying table 173 is moved in the conveying direction along the guide rails 170 by moving the coupling portion 172 of the rod-less cylinder 171 in the conveying direction, thereby conveying the work piece 181 on the accommodating table 178 to the conveyance position where the press insulation-displacing process is to be performed. In this case, when the follower roller 194 of the cam follower 190 comes to be spaced away from the cam 188, the two support rollers 195 are pressed against the two surfaces of the work piece 181 by the biasing force of the spring 193. Thus, the work piece 181, that had been partly positioned, can be supported while being fully positioned by the respective support rollers 195. As a result that the work piece 181 can be accommodated securely and fixed in the specified position between the positioning blocks 180. Therefore, the work piece 181 is prevented from displacement from the accommodating table 178 and can be held in such a manner that the press insulation-displacing process can be performed properly.

In the foregoing embodiment, the work 181 on the accommodating table 178 conveyed to the conveyance position can be held at a specified height and can be positioned with respect to the wire laying mold 16 by pushing the support columns 175 up by the push-up portions 166. Therefore, the work 181 can be easily set in the specified position from below with respect to the wire laying mold 16 fixed on the turntable 13, to which the press insulation-displacing process is to be performed, and the press insulation-displacing process can be properly performed.

In the foregoing embodiment, the pieces of the insulated wire 62, after the wire laying process and the press cutting process, are transferred from the wire laying mold 16 to the work piece 181 located below while being pushed by the pushing portions 157 from above the wire laying mold 16. In this case, the pieces of the insulated wire 62 tightly held in the wire laying mold 16 can be transferred to the specified positions on the work piece 181 while the pattern thereof is being maintained, so that the five pieces of the insulated wire 62 can be laid while being fastened to the wire mounts 184 and the insulation-displacing pieces 187 of the work piece 181. Accordingly, the pieces of the insulated wire 62 can be positioned easily with respect to the wire mounts 184 and the insulation-displacing pieces 187 of the work 181 by being transferred from the wire laying mold 16 to the work piece 181 located below. As a result, operability can be improved.

In the foregoing embodiment, the pair of recesses 158 are formed at the leading end of each pushing portion 157, and the leading end of the pushing portion 157 is so formed as to have a substantially T-shaped cross section. The pushing portions 157 can have its degree of pushing the insulated wire 62 controlled by its shape, and can be stably brought into contact with the insulated wire 62 to be transferred to the work piece 181 from the wire laying mold 16.

It should be noted that the foregoing embodiment may be changed as follows.

Although the pair of recesses 158 are formed at the leading end of each pushing portion 157 which is so formed as to have a substantially T-shaped cross section in the foregoing embodiment, the shape of the pushing portion 157 is not particularly limited to the one of the foregoing embodiment. In other words, the pushing portions 157 may have an other cross section, for example, U-shaped cross section provided that this cross section controls the pushing degree of the pushing portions 157 and the pushing portions 157 can be stably brought into contact with the pieces of the insulated wire 62 to be transferred from the wire laying mold 16 to the work 181.

Although the guide blocks 18, 19 are fixed to the frame 17 by the bolts 26 formed with a hexagonal hole in the foregoing embodiment, the fixing means is not particularly limited to the bolts 26, but may be, for example, an adhesive or a dual-surface adhesive tape. Alternatively, the frame and the guide blocks may be fixed by the engagement of projections and recesses.

Although the projections 23 in the form of a triangular prism are formed in specified positions of the bottom portion of each guide block 19 of the wire laying mold 16 along its longitudinal direction in the foregoing embodiment, the shape of the projections 23 are not limited to the one of the foregoing embodiment. In other words, it is sufficient for the projections 23 to have such a pointed shape as to tear or make it easy to tear the insulating coating 68 of the insulated wire 62 when the press cutting process is performed. For example, the projections 23 may be in the form of a spike or a needle.

Although the pressing blocks 110 are used as a wire straightening mechanism in the foregoing embodiment, the wire straightening mechanism is not particularly limited thereto. Any member can be used provided that it can straighten the insulated wire 62 by pressing it.

Although the work 181 is accommodated while being partly positioned between the positioning blocks 180 on the accommodating table 178 in the foregoing embodiment, it may be partly positioned by using, for example, bolts instead of the positioning blocks 180.

What is claimed is:

1. A wire laying apparatus for laying a wire on a work piece, comprising:

a wire laying mechanism for laying the wire on a wire laying mold from substantially above the wire laying mold, the wire laying mold comprising at least one frame and at least one guide block, guide holes for laying the wire being formed inside the frame by fixing the guide blocks in specified positions with respect to the frame, a press cutting mechanism for pressing the wire after being laid and cutting unnecessary portions of the wire, and a press insulation-displacing mechanism for transferring the wire after the press cutting from the wire laying mold to the work piece located therebelow.

2. A wire laying apparatus according to claim 1, wherein the press insulation-displacing mechanism comprises a press insulation-displacing assembly, and the wire is bringable substantially into contact with wire mounts and insulation-displacing pieces of the work piece by a pushing portion of the press insulation-displacing assembly.

3. A wire laying apparatus according to claim 2, wherein a pair of recesses are formed at the leading end of each pushing portion which is formed to have a substantially T-shaped cross-section.

4. A wire laying apparatus according to claim 1, wherein the wire laying mechanism, the press cutting mechanism and the insulation-displacing mechanism are provided on a base, and a turntable being provided on the base for conveying the work piece to positions corresponding to the wire laying mechanism, the press cutting mechanism and the insulation-displacing mechanism while holding the work piece.

5. A wire laying apparatus according to claim 4, wherein the wire laying mechanism comprises a wire feeder provided at a side of the base, a wire laying robot provided on the base, and a backup assembly provided on the base such that the turntable is arranged substantially between the wire laying robot and the backup assembly.

6. A wire laying apparatus according to claim 4, wherein the press cutting mechanism comprises a press cutting assembly provided on the base, and a backup assembly provided on the base so that the turntable is arranged substantially between the press cutting assembly and the backup assembly.

7. A wire laying apparatus for laying a wire on a work piece, comprising:

a wire laying mechanism for laying the wire on a wire laying mold from substantially above the wire laying mold, a press cutting mechanism for pressing the wire after being laid and cutting unnecessary portions of the wire, a press insulation-displacing mechanism for transferring the wire after the press cutting from the wire laying mold to the work piece located therebelow, a backup assembly for positioning a work piece with respect to the wiring laying mold from a location below the wire laying mold so that the wire laying mold and the work piece are held in predetermined positions when the wire on the wire laying mold is transferred to the work piece, and a conveying section and an elevation section disposed such that the work piece is moved to the predetermined position with respect to the wire laying mold by the conveying section and the elevating section.

8. A wire laying apparatus according to claim 1, wherein the frame is formed with at least one internally threaded portion and the guide blocks are formed with oblong holes, the frame and the guide blocks being fixed to each other by bolts.

9. A wire laying apparatus according to claim 8, wherein the guide blocks are formed at their bottom portions with projections having a pointed end so as to tightly hold the wire when a press cutting process is applied to the wire.

10. A wire laying apparatus according to claim 9, wherein the pointed projections are substantially in the form of a triangular prism.

11. A wire laying apparatus according to claim 10, wherein the guide blocks are formed with support portions projecting at their bottom portions so as to tightly hold the wire when the press cutting process is applied to the wire.

12. A wire laying apparatus for laying a wire on a work piece, comprising:

a wire laying mechanism for laying the wire on a wire laying mold from substantially above the wire laying mold, a wire straightening mechanism for pressing and straightening a wire laid on the wire laying mold, a press cutting mechanism for pressing the wire after being laid and cutting unnecessary portions of the wire, and a press insulation-displacing mechanism for transferring the wire after the press cutting from the wire laying mold to the work piece located therebelow.

13. A wire laying apparatus according to claim 12, wherein wire straightening mechanism comprises at least one pressing block for pressing the wire.

14. A wire laying apparatus according to claim 13, further comprising a backup assembly for supporting the wiring laying mold, wherein the wire is pressed and straightened after the wire laying mold is supported by the backup assembly.

15. A wire laying apparatus according to claim 14, further comprising a backup portion which is movable substantially upwardly and downwardly and is bringable into contact with the wire laid on the wire laying mold in its upper position, the press cutting assembly including the pressing blocks which are movable substantially upwardly and downwardly and press the wire laid on the wire laying mold together with the backup assembly in its lower position.

16. A wire laying apparatus according to 15, wherein the press cutting assembly comprises one or more dampers for elastically pressing the pressing blocks against the wire.

17. A wire laying apparatus according to claim 7, wherein the work piece is accommodated on an accommodating table of the conveying section while being partly positioned, and is fixedly supported in the predetermined position while being positioned by one or more support rollers.

18. A wire laying apparatus according to claim 17, further comprising a positioning means for pressing the support rollers against the work piece as the work piece is conveyed to the elevating section by the conveying section while substantially canceling the positioning of the work piece by the support rollers as the work piece is conveyed to its set position by the conveying section.

19. A wire laying apparatus according to claim 18, wherein the positioning means comprises a cam provided in vicinity of the set position of the work piece, and a cam follower engageable with the cam and including the support rollers which are rotatably biased to position the work piece.

* * * * *